US009885967B2

(12) United States Patent
Miyaake et al.

(10) Patent No.: US 9,885,967 B2
(45) Date of Patent: Feb. 6, 2018

(54) RESIN FOR TONER, TONER, DEVELOPER, IMAGE FORMING APPARATUS, AND PROCESS CARTRIDGE

(71) Applicants: Azumi Miyaake, Kanagawa (JP); Daisuke Asahina, Shizuoka (JP); Toyoshi Sawada, Kanagawa (JP); Hiroshi Yamashita, Shizuoka (JP); Tsuyoshi Sugimoto, Shizuoka (JP); Shinya Nakayama, Shizuoka (JP); Susumu Chiba, Shizuoka (JP); Satoyuki Sekiguchi, Shizuoka (JP)

(72) Inventors: Azumi Miyaake, Kanagawa (JP); Daisuke Asahina, Shizuoka (JP); Toyoshi Sawada, Kanagawa (JP); Hiroshi Yamashita, Shizuoka (JP); Tsuyoshi Sugimoto, Shizuoka (JP); Shinya Nakayama, Shizuoka (JP); Susumu Chiba, Shizuoka (JP); Satoyuki Sekiguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/021,638

(22) PCT Filed: Aug. 13, 2014

(86) PCT No.: PCT/JP2014/071689

§ 371 (c)(1),
(2) Date: Mar. 11, 2016

(87) PCT Pub. No.: WO2015/037400

PCT Pub. Date: Mar. 19, 2015

(65) Prior Publication Data

US 2016/0223926 A1 Aug. 4, 2016

(30) Foreign Application Priority Data

Sep. 13, 2013 (JP) ..... 2013-190811

(51) Int. Cl.
*G03G 9/087* (2006.01)
*G03G 9/08* (2006.01)
*G03G 15/08* (2006.01)

(52) U.S. Cl.
CPC ..... *G03G 9/0821* (2013.01); *G03G 9/08764* (2013.01); *G03G 9/08788* (2013.01);
(Continued)

(58) Field of Classification Search
CPC ..... G03G 9/0821; G03G 9/08788; G03G 9/08797; G03G 9/08795; G03G 9/08764; G03G 15/08
See application file for complete search history.

(56) References Cited

U.S. PATENT DOCUMENTS 4,620,987 A 11/1986 Yamashita et al.
4,885,350 A 12/1989 Yamashita et al.
(Continued)

FOREIGN PATENT DOCUMENTS

EP 2 607 955 A1 6/2013
JP 63-027855 2/1988
(Continued)

OTHER PUBLICATIONS

Translation of JP 2010-077419.*
(Continued)

*Primary Examiner* — Peter Vajda
(74) *Attorney, Agent, or Firm* — Oblon, McClelland, Maier & Neustadt, L.L.P.

(57) ABSTRACT

Provided is a resin for a toner, which is a copolymer including a crystalline segment, and having a maximum elastic stress value at 100° C. (ES100) of 1,000 Pa or less, and a maximum elastic stress value at 70° C. (ES70) of 1,000 Pa or greater when the temperature is lowered from 100° C. to 70° C., where the maximum elastic stress values
(Continued)

are measured according to a large amplitude oscillatory shear procedure.

17 Claims, 6 Drawing Sheets

(52) U.S. Cl.
CPC ..... *G03G 9/08795* (2013.01); *G03G 9/08797* (2013.01); *G03G 15/08* (2013.01)

(56) References Cited

U.S. PATENT DOCUMENTS

| | | | |
|---|---|---|---|
| 5,368,972 | A | 11/1994 | Yamashita et al. |
| 5,541,031 | A | 7/1996 | Yamashita et al. |
| 5,576,393 | A | 11/1996 | Yamashita et al. |
| 6,140,000 | A | 10/2000 | Yamashita |
| 6,329,115 | B1 | 12/2001 | Yamashita |
| 6,416,914 | B1 | 7/2002 | Nakamura et al. |
| 6,632,579 | B1 | 10/2003 | Yamashita |
| 7,214,461 | B2 | 5/2007 | Yamashita et al. |
| 7,374,851 | B2 | 5/2008 | Nakayama et al. |
| 8,673,528 | B2 | 3/2014 | Sugimoto et al. |
| 8,735,037 | B2 | 5/2014 | Yamashita et al. |
| 8,741,520 | B2 | 6/2014 | Sawada et al. |
| 2001/0046636 | A1 | 11/2001 | Daimon et al. |
| 2002/0132177 | A1 | 9/2002 | Sawada et al. |
| 2003/0077536 | A1 | 4/2003 | Yamashita et al. |
| 2003/0129518 | A1 | 7/2003 | Sawada et al. |
| 2003/0162112 | A1 | 8/2003 | Yamashita et al. |
| 2003/0219669 | A1 | 11/2003 | Yamashita et al. |
| 2003/0219670 | A1 | 11/2003 | Sawada et al. |
| 2005/0196692 | A1 | 9/2005 | Yamashita et al. |
| 2005/0250037 | A1 | 11/2005 | Sawada et al. |
| 2005/0277046 | A1 | 12/2005 | Sawada et al. |
| 2006/0068312 | A1 | 3/2006 | Yamashita et al. |
| 2006/0177756 | A1 | 8/2006 | Sugimoto et al. |
| 2006/0204880 | A1 | 9/2006 | Mizutani et al. |
| 2006/0292482 | A1 | 12/2006 | Yamashita et al. |
| 2007/0015077 | A1 | 1/2007 | Yamashita et al. |
| 2008/0050669 | A1 | 2/2008 | Ohmura et al. |
| 2008/0070151 | A1 | 3/2008 | Sugimoto et al. |
| 2008/0076055 | A1 | 3/2008 | Sawada et al. |
| 2008/0118855 | A1 | 5/2008 | Nakayama et al. |
| 2008/0261131 | A1 | 10/2008 | Nakayama et al. |
| 2008/0268366 | A1 | 10/2008 | Nakayama et al. |
| 2008/0280219 | A1 | 11/2008 | Nakayama et al. |
| 2008/0318143 | A1 | 12/2008 | Nakayama et al. |
| 2008/0318148 | A1 | 12/2008 | Sugimoto et al. |
| 2009/0092917 | A1 | 4/2009 | Sugimoto et al. |
| 2009/0142094 | A1 | 6/2009 | Sawada et al. |
| 2009/0214973 | A1 | 8/2009 | Sugimoto et al. |
| 2010/0028795 | A1 | 2/2010 | Magome et al. |
| 2010/0035170 | A1 | 2/2010 | Sugimoto et al. |
| 2011/0065039 | A1 | 3/2011 | Ota et al. |
| 2011/0294064 | A1 | 12/2011 | Miyaake et al. |
| 2012/0282000 | A1 | 11/2012 | Nakayama et al. |
| 2013/0078563 | A1 | 3/2013 | Nakayama et al. |
| 2013/0095422 | A1 | 4/2013 | Yamamoto et al. |
| 2013/0108950 | A1 | 5/2013 | Yamamoto et al. |
| 2013/0130171 | A1 | 5/2013 | Watanabe et al. |
| 2013/0143155 | A1 | 6/2013 | Santo et al. |
| 2013/0157183 | A1 | 6/2013 | Santo et al. |
| 2013/0157185 | A1 | 6/2013 | Sakashita et al. |
| 2013/0157193 | A1 | 6/2013 | Moritani et al. |
| 2013/0236826 | A1 | 9/2013 | Makabe et al. |
| 2013/0236828 | A1 | 9/2013 | Mizoguchi et al. |
| 2013/0244011 | A1 | 9/2013 | Sabu et al. |
| 2013/0244153 | A1 | 9/2013 | Nakayama et al. |
| 2013/0244154 | A1 | 9/2013 | Yamamoto et al. |
| 2013/0244168 | A1 | 9/2013 | Yamashita et al. |
| 2013/0244169 | A1 | 9/2013 | Miyaake et al. |
| 2013/0252158 | A1 | 9/2013 | Yamada et al. |
| 2013/0260298 | A1 | 10/2013 | Amemori et al. |
| 2013/0330522 | A1 | 12/2013 | Suzuki et al. |
| 2013/0337374 | A1 | 12/2013 | Sugimoto et al. |
| 2013/0337376 | A1 | 12/2013 | Watanabe et al. |
| 2014/0023965 | A1 | 1/2014 | Chiba et al. |
| 2014/0051019 | A1 | 2/2014 | Sekiguchi et al. |
| 2014/0065534 | A1 | 3/2014 | Amemori et al. |
| 2014/0080046 | A1 | 3/2014 | Asahina et al. |
| 2014/0080047 | A1 | 3/2014 | Takahashi et al. |
| 2014/0080050 | A1 | 3/2014 | Asahina et al. |
| 2014/0113226 | A1 | 4/2014 | Ishii et al. |
| 2014/0270874 | A1 | 9/2014 | Hase et al. |
| 2014/0272689 | A1 | 9/2014 | Yamashita et al. |
| 2016/0091812 | A1 | 3/2016 | Makabe et al. |

FOREIGN PATENT DOCUMENTS

| | | | | |
|---|---|---|---|---|
| JP | 04-024702 | | 4/1992 | |
| JP | 04-024703 | | 4/1992 | |
| JP | 3360527 | | 10/2002 | |
| JP | 2005-275235 | A | 10/2005 | |
| JP | 2006-071906 | | 3/2006 | |
| JP | 2006-251564 | | 9/2006 | |
| JP | 3910338 | | 2/2007 | |
| JP | 3949553 | | 4/2007 | |
| JP | 2007-286144 | | 11/2007 | |
| JP | 4155108 | | 7/2008 | |
| JP | 4218303 | | 11/2008 | |
| JP | 2010-077419 | * | 4/2010 | ..... C08J 3/16 |
| JP | 4569546 | | 8/2010 | |
| JP | 2010-191197 | A | 9/2010 | |
| JP | 2010-217849 | * | 9/2010 | ..... G03G 9/087 |
| JP | 2012-012481 | * | 1/2012 | ..... C08J 3/12 |
| JP | 2012-027212 | | 2/2012 | |
| RU | 2 454 691 | | 6/2017 | |
| WO | WO 2014/184979 | A1 | 11/2014 | |

OTHER PUBLICATIONS

Translation of JP 2012-012481.*
Translation of JP 2010-217849.*
Japanese Information Offer Forms issued Feb. 22, 2016 in Japanese Patent Application No. 2013-190811 (with English language translation).
International Search Report dated Oct. 7, 2014 for counterpart International Patent Application No. PCT/JP2014/071689 filed Aug. 13, 2014.
U.S. Appl. No. 08/165,101, filed Dec. 10, 1993.
Extended European Search Report dated Jul. 18, 2016 in Patent Application No. 14844051.4.
Russian Official Decision on Grant dated Jun. 27, 2017, Application No. 2016113705 (with English translation).

* cited by examiner

RESIN FOR TONER, TONER, DEVELOPER, IMAGE FORMING APPARATUS, AND PROCESS CARTRIDGE

CROSS-REFERENCE TO RELATED APPLICATIONS

This application is a National Stage of PCT/JP2014/071689, which was filed on Aug. 13, 2014. This application is based upon and claims the benefit of priority to Japanese Application No. 2013-190811, which was filed on Sep. 13, 2013.

TECHNICAL FIELD

The present invention relates to a resin for a toner, a toner, a developer, an image forming apparatus, and a process cartridge.

BACKGROUND ART

Conventionally, a latent image electrically or magnetically formed in an electrophotographic image forming apparatus or the like is developed with an electrophotographic toner (hereinafter may be referred to simply as "toner"). In electrophotography, for example, an electrostatic charge image (latent image) is formed on a photoconductor and then developed with a toner, thereby a toner image is formed. Typically, the toner image is transferred onto a transfer material such as a sheet, and then fixed on the transfer material such as a sheet. In a fixing step of fixing the toner image on a transfer sheet, heat fixing techniques such as a heating roller fixing technique and a heating belt fixing technique are commonly used, because of their high energy efficiency.

Recently, demands from the market for faster and more energy-saving operations of image forming apparatuses have been increasing, and toners that are excellent in low temperature fixability and capable of providing high-quality images have been requested. As a method for ensuring a toner low temperature fixability, there is a method of lowering the softening temperature of the binder resin of the toner. However, when the softening temperature of the binder resin is low, there are increased chances of so-called offset, in which a toner image partially adheres to the surface of the fixing members, and the adhered image transfers to a copy sheet (hereinafter also referred to as hot offset). Furthermore, heat resistant storage stability of the toner degrades, and there may occur so-called blocking, in which toner particles fuse with each other particularly under high-temperature conditions. In addition, there also occurs a problem in the developing device, that the toner melts and adheres to the internal portions of the developing device and the carrier to contaminate them, or there occurs a problem that it is more likely for the surface of a photoconductor to be filmed with the toner.

Using a crystalline resin as a binder resin of a toner is known as a technique that can solve these problems. A crystalline resin has a characteristic of rapidly softening from its crystalline state when it gets to the melting point. Therefore, it can lower the fixing temperature of the toner significantly while securing the heat resistant storage stability that is expressed at or below the melting point. That is, it can satisfy low temperature fixability and heat resistant storage stability at the same time at high levels. However, a crystalline resin having a melting point that allows low temperature fixability to be expressed is soft and susceptible to plastic deformation, although it is excellent in toughness. Therefore, simply using a crystalline resin as a binder resin results in a toner with a very poor mechanical durability, which causes various troubles in the image forming apparatus, such as deformation, aggregation, adherence, contamination of the members in the apparatus, etc.

Hence, there have conventionally been proposed many toners that use a crystalline resin and an amorphous resin in combination, as toners using a crystalline resin as a binder resin (see PTLs 1 to 5). They are better at satisfying low temperature fixability and heat resistant storage stability at the same time, than conventional toners made only of an amorphous resin. However, when the crystalline resin gets exposed on the surface of the toner, there occurs a problem that the toner particles aggregate due to stress of being stirred in the developing device, to constitute a cause of a white void. Therefore, this technique has not been able to take full advantage of a crystalline resin, because the additive amount of the crystalline resin should be limited.

There are also proposed many toners that use a resin in which a segment having crystallinity and a segment having an amorphous property are chemically bonded with each other. For example, there are proposed toners that use as a binder resin, a resin in which crystalline polyester and polyurethane are bonded with each other (see PTLs 6 and 7). There is proposed a toner that uses a resin in which crystalline polyester and an amorphous vinyl polymer are bonded with each other (see PTL 8). Further, there are proposed toners that use as a binder resin, a resin in which crystalline polyester and amorphous polyester are bonded with each other (see PTLs 9 to 11).

Furthermore, there are proposed a technique of adding inorganic fine particles to a binder resin made mainly of a crystalline resin (see PTL 12), and a toner that uses a crystalline resin having a cross-linked structure based on unsaturated linkage containing a sulfonic acid group (see PTL 13).

These proposed techniques are all excellent in satisfying low temperature fixability and heat resistant storage stability at the same time, but do not fundamentally remedy the softness attributed to the crystalline segment and cannot solve the problems related with the mechanical durability of the toner.

Moreover, as a major subject of the toners using a crystalline resin, there is a problem of scratch resistance of images. Because time is taken from when the toner melts on a fixing medium during heat fixing until when the crystalline resin in the toner gets recrystallized, the surface of the image cannot recover hardness quickly. Therefore, there occur problems that a scar is generated on the surface of the image or the glossiness changes, due to contact and sliding friction with a sheet discharging roller, a conveying member, etc. in a sheet discharging step after the fixing.

Further, when a resin in which a crystalline segment and an amorphous segment are chemically bonded with each other is used, the sharp melt property of the crystalline segment may not be maintained well, depending on the composition used and the linkage. Moreover, there is also a problem that the pigment tends to be located unevenly in such a resin, like in a crystalline resin.

Hence, it is currently requested to provide a resin for a toner, with which it is possible to obtain a toner that can satisfy low temperature fixability and heat resistant storage stability at the same time at high levels, and has excellent scratch resistance and excellent pigment dispersibility.

CITATION LIST

Patent Literature

PTL 1 Japanese Patent (JP-B) No. 3949553
PTL 2 JP-B No. 4155108
PTL 3 Japanese Patent Application Laid-Open (JP-A) No. 2006-071906
PTL 4 JP-A No. 2006-251564
PTL 5 JP-A No. 2007-286144
PTL 6 Japanese Patent Application Publication (JP-B) No. 04-024702
PTL 7 JP-B No. 04-024703
PTL 8 JP-A No. 63-027855
PTL 9 JP-B No. 4569546
PTL 10 JP-B No. 4218303
PTL 11 JP-A No. 2012-27212
PTL 12 JP-B No. 3360527
PTL 13 JP-B No. 3910338

SUMMARY OF INVENTION

Technical Problem

The present invention aims to solve the various conventional problems described above and achieve the following object. That is, an object of the present invention is to provide a resin for toner with which it is possible to obtain a toner that can satisfy low temperature fixability and heat resistant storage stability at the same time at high levels, and has excellent scratch resistance and excellent pigment dispersibility.

Solution to Problem

Means for solving the problems described above is as follows.

A resin for a toner of the present invention is a copolymer including a crystalline segment, wherein the resin for a toner has a maximum elastic stress value at 100° C. (ES100) of 1,000 Pa or less, and a maximum elastic stress value at 70° C. (ES70) of 1,000 Pa or greater when a temperature is lowered from 100° C. to 70° C., where the maximum elastic stress values are measured according to a large amplitude oscillatory shear procedure.

Advantageous Effects of Invention

The present invention can provide a resin for a toner with which it is possible to obtain a toner that can solve the various conventional problems described above, can satisfy low temperature fixability and heat resistant storage stability at the same time at high levels, and has excellent scratch resistance and excellent pigment dispersibility.

Figure 1:
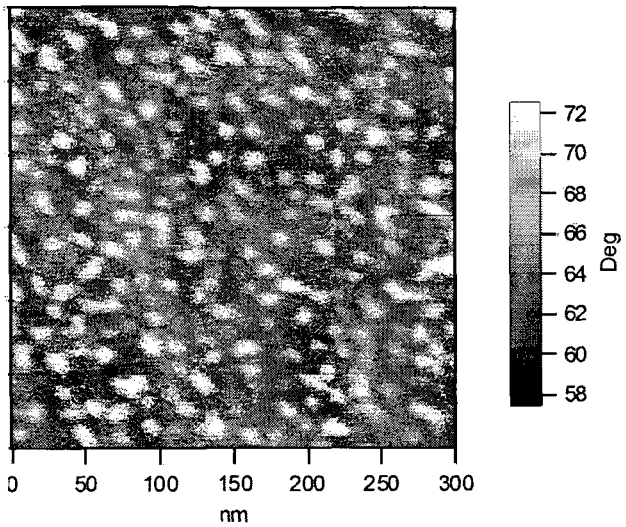
FIG. 1 shows an example of a phase image of a toner using a copolymer.

DESCRIPTION OF EMBODIMENTS (Resin for Toner, and Toner)

A resin for a toner of the present invention is a copolymer containing a crystalline segment.

The resin for a toner has a maximum elastic stress value at 100° C. (ES100) of 1,000 Pa or less, and a maximum elastic stress value at 70° C. (ES70) of 1,000 Pa or greater when the temperature is lowered from 100° C. to 70° C., where the values are measured according to a large amplitude oscillatory shear procedure.

The toner contains at least the resin for a toner described above.

The present inventors have conducted earnest studies in order to provide a toner that can satisfy low temperature fixability and heat resistant storage stability at the same time at high levels, and has excellent scratch resistance and excellent pigment dispersibility. As a result, the present inventors have found that it is possible to provide a toner that can satisfy low temperature fixability and heat resistant storage stability at the same time at high levels, and has excellent scratch resistance and excellent pigment dispersibility, by using as the resin for a toner, a resin for a toner, which is a copolymer that contains a crystalline segment, and has a maximum elastic stress value at 100° C. (ES100) of 1,000 Pa or less, and a maximum elastic stress value at 70° C. (ES70) of 1,000 Pa or greater when the temperature is lowered from 100° C. to 70° C., where the values are measured according to a large amplitude oscillatory shear procedure.

The present inventors have discovered a technique of chemically bonding a crystalline segment and an amorphous segment with each other and controlling the structure of each segment to thereby constrain a molecular motion of the crystalline segment. In addition to this technique, the present inventors have discovered a technique of reducing compatibility between the crystalline segment and the amorphous segment. It is possible to design the toner described above by using these techniques.

The plastically deformable property of the crystalline segment is considered due to a folding structure of polymer chains in the crystalline segment. The crystalline segment is composed of crystalline portions where molecular chains are aligned with each other in a folded state, and non-crystalline portions including folding portions of the molecular chains, and molecular chains that are present between the crystalline portions. Even a straight-chain polyethylene monocrystal having a high crystallinity contains non-crystalline portions by about 3%. High molecular mobility of these non-crystalline portions is considered to greatly contribute to the plastic deformation of the crystalline segment. In using a crystalline segment, it is important how well it is possible to constrain this molecular mobility.

To design the toner, it is preferable to select an amorphous segment that can constrain the molecular mobility of the crystalline segment, to form a microphase-separated structure between the crystalline segment and the amorphous segment in the toner, and to perform control for making a minute sea-island structure, in which the amorphous segment is the sea and the crystalline segment is the island. This makes it possible for the amorphous segment to constrain a molecular motion of the crystalline segment at or below the melting point thereof to thereby realize excellent mechanical durability, for the toner on the whole to elastically relax and deform smoothly in the fixing temperature range, for the amorphous segment to immediately constrain any excessive molecular motion of the crystalline segment during discharging of an image formed sheet, and for the minute sea-island structure to prevent the crystalline segment from being exposed on the surface of the image to thereby enable hardness to be recovered on the image quickly.

When the crystalline segment and the amorphous segment are a good match, they tend to be compatibilized when they are block-copolymerized, which may lower the melting peak attributed to the crystalline segment or lower the glass transition temperature of the whole of them. This may affect low temperature fixability and heat resistant storage stability. Hence, the compatibility between the crystalline segment and the amorphous segment may be reduced, which makes it possible to obtain a toner that can recover hardness on an image quickly as described above, while maintaining low temperature fixability and heat resistant storage stability. For this purpose, it is necessary that the resin for a toner have a maximum elastic stress value at 100° C. (ES100) of 1,000 Pa or less, and a maximum elastic stress value at 70° C. (ES70) of 1,000 Pa or greater when the temperature is lowered from 100° C. to 70° C., where the values are measured according to a large amplitude oscillatory shear procedure.

As a specific method for reducing the compatibility between the crystalline segment and the amorphous segment, it is effective to use as a monomer of the resin for a toner, a monomer that contains an odd number of carbon atoms in the main chain (odd monomer). Because an odd monomer cannot align as well as an even monomer that contains an even number of carbon atoms in the main chain, its hydrogen bonds, which are strong inter-molecular interactions, are only those of long-range interactions, which makes it possible to provide flexibility evoked by dipoles. This also improves pigment dispersibility.

It is possible to use the odd monomer in any of the crystalline segment and the amorphous segment. However, it is preferable to use it in the amorphous segment. Further, it is preferable that the amorphous segment contain the odd monomer in its structural units in an amount of from 1% by mass to 50% by mass.

The toner preferably contains a binder resin, and further contains other components according to necessity.

<Binder Resin>

The binder resin contains the resin for a toner described above, and further contains other resins according to necessity.

—Resin for Toner—

The resin for a toner is a copolymer containing a crystalline segment, and preferably contains an amorphous segment.

The copolymer is preferably a block copolymer made of the crystalline segment and the amorphous segment.

In the copolymer, it is preferable that the crystalline segment and the amorphous segment be bonded via urethane linkage, in terms of making it possible to maintain a high maximum fixing temperature.

By using the copolymer, it is possible to form a specific higher-order structure, of which representative example is a microphase-separated structure.

The copolymer is obtained by bonding different kinds of polymer chains via covalent binding. Generally, different kinds of polymer chains are often incompatible systems with each other, and do not mix like water and oil. In a simple mixture system, different kinds of polymer chains can move independently, and get macrophase-separated from each other hence. However, in a copolymer, different kinds of copolymer chains are linked with each other, and cannot therefore get macrophase-separated. However, although they are linked, they try as much as possible to separate from each other by aggregating with the same kind of polymer chains. Therefore, they cannot avoid being divided into A-rich portions and B-rich portions alternately, depending on the size of the polymer chains Therefore, when the degree of mixing between the component A and the component B, and their composition, length (molecular weight and distribution), and blending ratio are changed, the structure of their phase separation changes. Therefore, it is possible to control them to a periodic ordered mesostructure, such as a sphere structure, a cylinder structure, a gyroid structure, and a lamellar structure, as illustrated in, for example, A. K. Khandpur, S. Forster, and F. S. Bates, Macromolecules, 28 (1995), pp. 8,796-8,806.

The copolymer is composed of a crystalline component and an amorphous component. If it is possible to crystallize their microphase-separated structure to a copolymer that has the periodic ordered mesostructure described above, and hence to use their melt microphase-separated structure as a template, it is possible to obtain regular alignment of crystalline phases that is at the scale of from several ten nanometers to several hundred nanometers. Therefore, by taking advantage of such a higher-order structure, it is possible to impart sufficient flowability and deformability that are based on a solid-liquid phase transition phenomenon in the crystalline portions in a situation where flowability is required, such as during fixing, and to trap the crystalline portions inside the structure and constrain the mobility in a situation where flowability and deformability are not required, such as during storage and in a conveying step in the apparatus after fixing.

The molecular structure, crystallinity, and a higher-order structure such as a microphase-separated structure of the copolymer can be easily analyzed according to a conventional publicly-known technique. Specifically, they can be observed according to high resolution NMR measurement (1H, 13C, etc.), differential scanning calorimetry (DSC) measurement, wide-angle X-ray diffraction measurement, (pyrolysis) GC/MS measurement, LC/MS measurement, infrared absorption (IR) spectrometric measurement, atomic force microscope observation, and TEM observation.

For example, it is possible to judge whether the toner for a resin specified in the present invention is contained in a toner or not, in according to the following procedure.

First, a toner is dissolved in a solvent such as ethyl acetate and THF (or may be subjected to Soxhlet-extraction). Then, the resultant is subjected to centrifugation with a high-speed centrifuge equipped with a cooling function, for example, at 20° C. at 10,000 rpm for 10 minutes, to be separated into a soluble content and an insoluble content. The soluble content is refined through a plurality of times of reprecipitation. Through this process, a highly cross-linked resin component, a pigment, a wax, etc. can be split.

Then, the obtained resin component is measured according to GPC, to obtain its molecular weight and distribution, and chromatogram. When the obtained chromatogram is multimodal, the resin component is fractionated/split with a fraction collector or the like, and a film of each fraction is made. Through this operation, respective kinds of resin components are separated from each other and refined, to be each subjected to various analyses. Film formation of each fraction is performed by performing drying at reduced pressure on a Teflon petri dish to thereby volatilize the solvent.

Each obtained refined film is first subjected to DSC measurement to know its Tg, melting point, crystallization behavior, etc. When a crystallization peak is observed during cooling and temperature lowering, the film is annealed in that temperature range for 24 hours or longer to grow the crystalline component. When no crystallization is observed but a melting peak is observed, the film is annealed at about a temperature lower than the melting point by 10° C. This makes it possible to know various transition points and presence of any crystalline skeleton.

Next, with SPM observation, or as the case may be, TEM observation in combination, presence or absence of a phase-separated structure is confirmed. When a so-called micro-phase-separated structure can be confirmed, it means that the sample is a copolymer or a system that has a high intramolecular/intermolecular interaction.

The refined film is further subjected to FT-IR measurement, NMR measurement ($^{1}H$, $^{13}C$), GG/MS measurement, and as the case may be, NMR measurement (2D) that enables a greater-detailed analysis of the molecular structure. This allows for knowing the composition, structure, and various properties of the film, and for confirming the presence of, for example, any polyester skeleton or urethane linkage, and their compositions and composition ratio.

By comprehensively judging the results of the above measurements and analyses, it is possible to determine whether the resin for a toner specified in the present invention is contained in a toner.

Here, an example of the procedure and conditions of each of the above measurements will be presented.

<Example of GPC Measurement>

The measurement may be performed with a GPC measuring instrument (e.g., HLC-8220GPC manufactured by Tosoh Corporation), which is preferably one that is equipped with a fraction collector.

Columns may preferably be 3-continuous 15 cm columns TSKGEL SUPER HZM-H (manufactured by Tosoh Corporation). The resin to be measured is made into a 0.15% by mass solution of tetrahydrofuran (THF) (containing a stabilizing agent, manufactured by Wako Pure Chemical Industries, Ltd.), and filtered through a 0.2 μm filter, and the resulting filtrate is used as the sample. This THF sample solution (100 μL) is injected into the measuring instrument, and measured at a temperature of 40° C. at a flow rate of 0.35 mL/minute.

The molecular weight is calculated with calibration curves generated based on monodisperse polystyrene standard samples. The monodisperse polystyrene standard samples are SHOWDEX STNDARD SERIES manufactured by Showa Denko K.K. and toluene. THF solutions of the following three kinds of monodisperse polystyrene standard samples are made, and measured under the conditions described above. Calibration curves are generated by regarding a retention time of peak tops as light-scattering molecular weights of the monodisperse polystyrene standard samples.

Solution A: S-7450 (2.5 mg), S-678 (2.5 mg), S-46.5 (2.5 mg), S-2.90 (2.5 mg), and THF (50 mL)

Solution B: S-3730 (2.5 mg), S-257 (2.5 mg), S-19.8 (2.5 mg), S-0.580 (2.5 mg), and THF (50 mL)

Solution C: S-1470 (2.5 mg), S-112 (2.5 mg), S-6.93 (2.5 mg), toluene (2.5 mg), and THF (50 mL)

The detector may be a RI (refraction index) detector, but may be a UV detector with a higher sensitivity for when performing fractionation.

<Example of DSC Measurement>

A sample (5 mg) is sealed within a T-ZERO simple sealed pan manufactured by TA Instruments Inc., and measured with DSC (Q2000 manufactured by TA Instruments Inc.)

In the measurement, the sample is heated from 40° C. to 150° C. at a rate of 5° C./minute for the first heating, retained for 5 minutes, cooled to −70° C. at a rate of 5° C./minute, and retained for 5 minutes under nitrogen stream.

Then, the sample is heated at a temperature raising rate of 5° C./minute for the second heating. Resulting thermal changes of the sample are measured, an "endothermic/exothermic amount" vs. "temperature" graph is plotted, and Tg, cold crystallization, the melting point, the crystallization temperature, etc. of the sample are obtained according to a fixed rule. Tg is a value obtained according to a mid point procedure from the DSC curve of the first heating. It is also possible to split an enthalpy relaxation component by performing modulation of ±0.3° C. during temperature raising.

<Example of SPM Observation>

A tapping-mode phase image of the sample is observed with a SPM (e.g., an AFM).

In the resin for a toner of the present invention, it is preferable that portions that are soft and observed as large phase difference images and portions that are hard and observed as small phase difference images be minutely dispersed. In this case, it is important that second phase difference images formed by the hard and small phase difference portions be minutely dispersed as an external phase, and first phase difference images formed by the soft and large phase difference portions as an internal phase.

The sample from which to obtain a phase image may be a slice of a resin block obtained by cutting with, for example, an ultramicrotome ULTRACUT UCT manufactured by Lica Corporation under the conditions below.

Cutting thickness: 60 nm
Cutting speed: 0.4 mm/sec
With a diamond knife (ULTRA SONIC 35°)

A representative instrument for obtaining an AFM phase image is, for example, MFP-3D manufactured by Asylum Technology Co., Ltd. An AFM phase image can be observed under the measurement conditions below with OMCL-AC240TS-C3 as a cantilever.

Target amplitude: 0.5 V
Target percent: −5%
Amplitude setpoint: 315 mV
Scan rate: 1 Hz
Scan points: 256×256
Scan angle: 0°

<Example of TEM Observation>

[Procedure]

(1) A sample is exposed to an atmosphere of a $RuO_4$ aqueous solution, and subjected to staining for 2 hours.

(2) The sample is trimmed with a glass knife, and a slice of the sample is cut with an ultramicrotome under the conditions below.

—Cutting Conditions—

Cutting thickness: 75 nm
Cutting speed: from 0.05 mm/sec to 0.2 mm/sec
With a diamond knife (ULTRA SONIC 35°)

(3) The slice is fixed on a mesh, exposed to an atmosphere of a $RuO_4$ aqueous solution, and subjected to staining for 5 minutes.

[Observation Conditions]

Instrument used: a transmission electron microscope JEM-2100F manufactured by JEOL Ltd.

Acceleration voltage: 200 kV

Morphology observation: a bright-field procedure

Settings: spot size to 3, CLAP to 1, OLAP to 3, and Alpha to 3

<Example of FT-IR Measurement>

FT-IR spectrometric measurement is performed with a FT-IR spectrometer (product name "SPECTRUM ONE" manufactured by Perkin Elmer Co., Ltd.), for 16 scans, at a resolution of 2 $cm^{-1}$, and in a middle infrared range (from 400 $cm^{-1}$ to 4,000 $cm^{-1}$).

<Example of NMR Measurement>

A sample is dissolved in heavy chloroform at as high a concentration as possible, poured into a 5 mmφ NMR sample tube, and subjected to various NMR measurements. The measuring instrument is JNM-ECX-300 manufactured by JEOL Resonance Co., Ltd.

The measuring temperature is 30° C. in any of the measurements. $^1$H-NMR measurement is performed 256 times cumulatively, and in a repeating time of 5.0 s. $^{13}$C measurement is performed 10,000 times cumulatively, and in a repeating time of 1.5 s. From the obtained chemical shift, it is possible to ascribe the components, and calculate their blending ratio from a value obtained by dividing a corresponding integral peak value by the number of protons or carbon atoms.

For a more detailed structural analysis, it is possible to perform double-quantum-filtered 1H-1H shift correlation two-dimensional NMR (DQF-COSY) measurement. In this case, the measurement is performed 1,000 time cumulatively, and in a repeating time of 2.45 s or 2.80 s, and a coupling state of the structure, i.e., a reactive site can be specified from the obtained spectrum. However, the typical $^1$H and $^{13}$C measurements are enough for discriminating the structure.

<Example of GC/MS Measurement>

In this analysis, a reactive pyrolysis gas chromatography/mass spectrometry (GC/MS) procedure using a reactive reagent is performed. The reactive reagent used in the reactive pyrolysis GUMS procedure is a 10% by mass methanol solution of tetramethylammonium hydroxide (TMAH). A GC-MS instrument is QP2010 manufactured by Shimadzu Corporation, data analysis software is GCMS SOLUTION manufactured by Shimadzu Corporation, and a heater is PY2020D manufactured by Frontier Laboratories, Ltd.

[Analysis Conditions]

Reactive pyrolysis temperature: 300° C.

Column: ULTRA ALLOY-5, L=30 m, ID=0.25 mm, Film=0.25

Column temperature raising: 50° C. (retained for 1 minute) to 330° C. (retained for 11 minutes) at 10° C./min Carrier gas pressure: constant at 53.6 kPa Column flow rate: 1.0 mL/min Ionization procedure: an EI procedure (70 eV)

Mass range: m/z, from 29 to 70

Injection mode: Split (1:100)

——Crystalline Segment——

The crystalline segment is not particularly limited, and an appropriate one may be selected according to the purpose. However, it is preferably a crystalline polyester resin.

———Crystalline Polyester Resin———

The crystalline polyester resin is not particularly limited, and an appropriate one may be selected according to the purpose. Examples thereof include a polycondensed polyester resin synthesized from polyol and polycarboxylic acid, a lactone-ring-opening polymerization product, and polyhydroxy carboxylic acid.

The crystalline polyester resin is not particularly limited, and an appropriate one may be selected according to the purpose. However, it is preferably a crystalline polyester resin that contains as constituent components, a dihydric aliphatic alcohol component and a divalent aliphatic carboxylic acid component.

————Polyol————

Examples of the polyol include dihydric diol, and trihydric to octahydric or higher polyol.

The dihydic diol is not particularly limited, and an appropriate one may be selected according to the purpose. Examples thereof include: aliphatic alcohol such as straight-chain aliphatic alcohol and branched aliphatic alcohol (divalent aliphatic alcohol); alkylene ether glycol having 4 to 36 carbon atoms; alicyclic diol having 4 to 36 carbon atoms; alkylene oxide of the alicyclic diol ("alkylene oxide" may hereinafter be abbreviated as "AO"); bisphenol AO adduct; polylactone diol; polybutadiene diol, diol having a carboxyl group, diol having a sulfonic acid group or a sulfamic acid group; and diol having other functional groups, such as salts of those above. Among these, aliphatic alcohol having 2 to 36 carbon atoms in the chain is preferable, and straight-chain aliphatic alcohol having 2 to 36 carbon atoms in the chain is more preferable. One of these may be used alone, or two or more of these may be used in combination.

The content of the straight-chain aliphatic alcohol relative to the whole of the diol is not particularly limited and may be appropriately selected according to the purpose. However, it is preferably 80 mol % or greater, and more preferably 90 mol % or greater. When the content is greater than 80 mol % or greater, advantageously, the crystallinity of the resin will be high, simultaneous satisfaction of low temperature fixability and heat resistant storage stability will be good, and the resin hardness tends to be high.

The straight-chain aliphatic alcohol is not particularly limited, and an appropriate one may be selected according to the purpose. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among these, ethylene glycol, 1,4-butanediol, 1,6-hexanediol, 1,8-octanediol, 1,10-decanediol, and 1,12-dodecanediol are particularly preferable in that the crystallinity of the crystalline polyester resin will be high, and the sharp melt property thereof will be excellent.

The branched aliphatic alcohol is not particularly limited, and an appropriate one may be selected according to the purpose. However, it is preferably a branched aliphatic alcohol having 2 to 36 carbon atoms in the chain. Examples of the branched aliphatic alcohol include 1,2-propylene glycol, neopentyl glycol, and 2,2-diethyl-1,3-propanediol.

The alkylene ether glycol having 4 to 36 carbon atoms is not particularly limited, and an appropriate one may be selected according to the purpose. Examples thereof include diethylene glycol, triethylene glycol, dipropylene glycol, polyethylene glycol, polypropylene glycol, and polytetramethylene ether glycol.

The alicyclic diol having 4 to 36 carbon atoms is not particularly limited, and an appropriate one may be selected according to the purpose. Examples thereof include 1,4-cyclohexanedimethanol, and hydrogenated bisphenol A.

The trihydric to octahydric or higher polyol is not particularly limited, and an appropriate one may be selected according to the purpose. Examples thereof include; trihydric to octahydric or higher polyhydric aliphatic alcohol having 3 to 36 carbon atoms; trisphenol/AO adduct (with addition of from 2 to 30 moles); novolac resin/AO adduct (with addition of from 2 to 30 moles); and acrylic polyol such as a copolymer of hydroxyethyl(meth)acrylate with another vinyl-based monomer.

Examples of the trihydric to octahydric or higher polyhydric aliphatic alcohol having 3 to 36 carbon atoms include glycerin, trimethylolethane, trimethylolpropane, pentaerythritol, sorbitol, sorbitan, and polyglycerin.

Among these, trihydric to octahydric or higher polyhydric aliphatic alcohol and novolac resin/AO adduct are preferable, and novolac resin/AO adduct is more preferable.

————Polycarboxylic Acid————

Examples of the polycarboxylic acid include dicarboxylic acid, and trivalent to hexavalent or higher polycarboxylic acid.

The dicarboxylic acid is not particularly limited, and an appropriate one may be selected according to the purpose. Examples thereof include aliphatic dicarboxylic acid (divalent aliphatic carboxylic acid), and aromatic dicarboxylic acid. Examples of the aliphatic dicarboxylic acid include straight-chain aliphatic dicarboxylic acid and branched aliphatic dicarboxylic acid. Of these, straight-chain aliphatic dicarboxylic acid is preferable.

The aliphatic dicarboxylic acid is not particularly limited, and an appropriate one may be selected according to the purpose. Examples thereof include alkane dicarboxylic acid, alkenyl succinic acid, alkene dicarboxylic acid, and alicyclic dicarboxylic acid.

Examples of the alkane dicarboxylic acid include alkane dicarboxylic acid having 4 to 36 carbon atoms. Examples of the alkane dicarboxylic acid having 4 to 36 carbon atoms include succinic acid, adipic acid, sebacic acid, azelaic acid, dodecanedicarboxylic acid, octadecanedicarboxylic acid, and decylsuccinic acid.

Examples of the alkenyl succinic acid include dodecenyl succinic acid, pentadecenyl succinic acid, and octadecenyl succinic acid.

Examples of the alkene dicarboxylic acid include alkene dicarboxylic acid having 4 to 36 carbon atoms. Examples of the alkene dicarboxylic acid having 4 to 36 carbon atoms include maleic acid, fumaric acid, and citraconic acid.

Examples of the alicyclic dicarboxylic acid include alicyclic dicarboxylic acid having 6 to 40 carbon atoms. Examples of the alicyclic dicarboxylic acid having 6 to 40 carbon atoms include dimer acid (dimerized linoleic acid).

The aromatic dicarboxylic acid is not particularly limited, and an appropriate one may be selected according to the purpose. Examples thereof include aromatic dicarboxylic acid having 8 to 36 carbon atoms. Examples of the aromatic dicarboxylic acid having 8 to 36 carbon atoms include phthalic acid, isophthalic acid, terephthalic acid, t-butylisophthalic acid, 2,6-naphthalene dicarboxylic acid, and 4,4'-biphenyl dicarboxylic acid.

Examples of the trivalent to hexavalent or higher polycarboxylic acid include aromatic polycarboxylic acid having 9 to 20 carbon atoms. Examples of the aromatic polycarboxylic acid having 9 to 20 carbon atoms include trimellitic acid and pyromellitic acid.

The dicarboxylic acid or the trivalent to hexavalent or higher polycarboxylic acid may be acid anhydride of those above, or may be alkyl ester of those above having 1 to 4 carbon atoms. Examples of the alkyl ester having 1 to 4 carbon atoms include methyl ester, ethyl ester, and isopropyl ester.

Among the examples of the dicarboxylic acid, it is preferable to use aliphatic dicarboxylic acid alone, and it is more preferable to use adipic acid, sebacic acid, dodecane dicarboxylic acid, terephthalic acid, or isophthalic acid alone. A copolymerization product of the aliphatic dicarboxylic acid together with the aromatic dicarboxylic acid is likewise preferable. Examples of preferable aromatic dicarboxylic acid to be copolymerized include terephthalic acid, isophthalic acid, t-butylisophthalic acid, and alkyl ester of these aromatic dicarboxylic acid. Examples of the alkyl ester include methyl ester, ethyl ester, and isopropyl ester. The amount of the aromatic dicarboxylic acid to be copolymerized is preferably 20 mol % or less.

It is preferable that the crystalline segment have an ester bond represented by the general formula (2) below, in terms of low temperature fixability.

$$—[OCO—(CH_2)_m—COO—(CH_2)_q]— \quad \text{General Formula (2)}$$

In the general formula (2) above, m represents an even number of from 2 to 20, and q represents an even number of from 2 to 20. The value m is preferably from 2 to 20, and more preferably from 4 to 10. The value q is preferably from 2 to 20, and more preferably from 4 to 10.

The melting point of the crystalline segment is not particularly limited, and may be appropriately selected according to the purpose. However, it is preferably from 50° C. to 75° C. When the melting point is lower than 50° C., the crystalline segment may be likely to melt at a low temperature, which may degrade the heat resistant storage stability of the toner. When the melting point is higher than 75° C., the crystalline segment may not melt sufficiently when heated during fixing, which may degrade the low temperature fixability of the toner. When the melting point is in the preferable range, advantageously, low temperature fixability and heat resistant storage stability will be more excellent. The hydroxyl value of the crystalline segment is not particularly limited, and may be appropriately selected according to the purpose. However, it is preferably from 5 mgKOH/g to 40 mgKOH/g.

The weight average molecular weight of the crystalline segment is not particularly limited and may be appropriately selected according to the purpose. However, it is preferably from 3,000 to 30,000, and more preferably from 5,000 to 25,000. The weight average molecular weight of the crystalline segment can be measured according to, for example, gel permeation chromatography (GPC).

The crystallinity, molecular structure, etc. of the crystalline segment can be confirmed according to, for example, NMR measurement, differential scanning calorimetry (DSC) measurement, X-ray diffraction measurement, GC/MS measurement, LC/MS measurement, infrared absorption (IR) spectrometric measurement, etc.

——Amorphous Segment——

The amorphous segment is not particularly limited, and an appropriate one may be selected according to the purpose. However, it is preferably an amorphous polyester resin.

————Amorphous Polyester Resin————

The amorphous polyester resin is not particularly limited, and an appropriate one may be selected according to the purpose. Examples thereof include polycondensed polyester resin synthesized from polyol and polycarboxylic acid.

The amorphous polyester resin is not particularly limited, and an appropriate one may be selected according to the purpose. However, it is preferably an amorphous polyester resin containing a dihydric aliphatic alcohol component and a polyvalent aromatic carboxylic acid component as the constituent components.

——Polyol——

Examples of the polyol include dihydric diol, and trihydric to octahydric or higher polyol.

The divalent diol is not particularly limited, and an appropriate one may be selected according to the purpose. Examples thereof include aliphatic alcohol such as straight-chain aliphatic alcohol and branched aliphatic alcohol (dihydric aliphatic alcohol). Among these, aliphatic alcohol having 2 to 36 carbon atoms in the chain is preferable, and straight-chain aliphatic alcohol having 2 to 36 carbon atoms in the chain is more preferable. One of these may be used alone, or two or more of these may be used in combination.

The straight-chain aliphatic alcohol is not particularly limited, and an appropriate one may be selected according to the purpose.

Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1, 12-dodecanediol, 1,13-tridecanediol, 1, 14-tetradecanediol, 1,18-octadecanediol, and 1,20-eicosanediol. Among these, ethylene glycol, 1,3-propanediol (propylene glycol), 1,4-butanediol, 1,6-hexanediol, 1,9-nonanediol, and 1,10-decanediol are preferable in terms of easy availability. Among these, straight-chain aliphatic alcohol having 2 to 36 carbon atoms in the chain is preferable.

——Polycarboxylic Acid——

Examples of the polycarboxylic acid include dicarboxylic acid, and trivalent to hexavalent or higher polycarboxylic acid. Among these, polyvalent aromatic carboxylic acid is preferable.

The dicarboxylic acid is not particularly limited, and an appropriate one may be selected according to the purpose. Examples thereof include aliphatic dicarboxylic acid, and aromatic dicarboxylic acid. Examples of the aliphatic dicarboxylic acid include straight-chain aliphatic dicarboxylic acid, and branched aliphatic dicarboxylic acid. Among these, straight-chain aliphatic dicarboxylic acid is preferable.

The aliphatic dicarboxylic acid is not particularly limited, and an appropriate one may be selected according to the purpose. Examples thereof include alkane dicarboxylic acid, alkenyl succinic acid, alkene dicarboxylic acid, and alicyclic dicarboxylic acid.

Examples of alkane dicarboxylic acid include alkane dicarboxylic acid having 4 to 36 carbon atoms. Examples of the alkane dicarboxylic acid having 4 to 36 carbon atoms include succinic acid, adipic acid, sebacic acid, azelaic acid, dodecane dicarboxylic acid, octadecane dicarboxylic acid, and decyl succinic acid.

Examples of the alkenyl succinic acid include dodecenyl succinic acid, pentadecenyl succinic acid, and octadecenyl succinic acid.

Examples of the alkene dicarboxylic acid include alkene dicarboxylic acid having 4 to 36 carbon atoms. Examples of the alkene dicarboxylic acid having 4 to 36 carbon atoms include maleic acid, fumaric acid, and citraconic acid.

Examples of the alicyclic dicarboxylic acid include alicyclic dicarboxylic acid having 6 to 40 carbon atoms. Examples of the alicyclic dicarboxylic acid having 6 to 40 carbon atoms include dimer acid (dimerized linoleic acid).

The aromatic dicarboxylic acid is not particularly limited, and an appropriate one may be selected according to the purpose. Examples thereof include aromatic dicarboxylic acid having 8 to 36 carbon atoms. Examples of the aromatic dicarboxylic acid having 8 to 36 carbon atoms include phthalic acid, isophthalic acid, terephthalic acid, t-butylisophthalic acid, 2,6-naphthalene dicarboxylic acid, and 4,4'-biphenyl dicarboxylic acid.

Examples of the trivalent to hexavalent or higher polycarboxylic acid include aromatic polycarboxylic acid having 9 to 20 carbon atoms. Examples of the aromatic polycarboxylic acid having 9 to 20 carbon atoms include trimellitic acid and pyromellitic acid.

The dicarboxylic acid or the trivalent to hexavalent or higher polycarboxylic acid may be acid anhydride of those above, or may be alkyl ester of those above having 1 to 4 carbon atoms. Examples of the alkyl ester having 1 to 4 carbon atoms include methyl ester, ethyl ester, and isopropyl ester.

The glass transition temperature of the amorphous segment is not particularly limited, and may be appropriately selected according to the purpose. However, it is preferably from 50° C. to 70° C. When the glass transition temperature is lower than 50° C., heat resistant storage stability may degrade, and durability against stress from stirring, etc. in the developing device may degrade. When the glass transition temperature is higher than 70° C., low temperature fixability may degrade. The glass transition temperature of the amorphous segment can be measured according to, for example, a differential scanning calorimetry (DSC) procedure. When the glass transition temperature is in the preferable range, advantageously, low temperature fixability and heat resistant storage stability will be more excellent.

The hydroxyl value of the amorphous segment is not particularly limited, and may be appropriately selected according to the purpose. However, it is preferably from 5 mgKOH/g to 40 mgKOH/g.

The weight average molecular weight of the amorphous segment is not particularly limited, and may be appropriately selected according to the purpose. However, it is preferably from 3,000 to 30,000, and more preferably from 5,000 to 25,000. The weight average molecular weight of the amorphous segment can be measured according to, for example, gel permeation chromatography (GPC).

The molecular structure of the amorphous segment can be confirmed according to, NMR measurement based on a solution or a solid, GC/MS, LC/MS, IR measurement, etc.

It is preferable that the constituent monomer of the copolymer contain a monomer having an odd number of carbon atoms in the main chain (odd monomer).

It is preferable that the constituent monomer of the amorphous segment contain a monomer having an odd number of carbon atoms in the main chain, and a monomer having an even number of carbon atoms in the main chain.

It is preferable that the constituent monomer of the crystalline segment contain a monomer having an even number of carbon atoms in the main chain.

Here, "the number of carbon atoms in the main chain" means the number of carbon atoms between two reactive functional groups of the monomer.

In terms of reducing the compatibility between the crystalline segment and the amorphous segment, it is preferable that at least either of the crystalline segment and the amorphous segment contain as the constituent monomer of that segment, a monomer having an odd number of carbon atoms in the main chain. A diol represented by the general formula (1) below is preferable as the monomer having an odd number of carbon atoms in the main chain.

$$HO—(CR^1R^2)_n—OH \quad \text{General Formula (1)}$$

In the general formula (1) above, $R^1$ and $R^2$ each independently represent a hydrogen atom, and an alkyl group having 1 to 3 carbon atoms. n represents an odd number of from 3 to 9. In the n repeating units, $R^1$ and $R^2$ each may be constant or may be varied.

The value n is preferably from 3 to 5, and more preferably 3. $R^1$ and $R^2$ are preferably a hydrogen atom and a methyl group.

Preferable examples of the diol represented by the general formula (1) above include 1,3-propanediol, 1,3-butaneidol, neopentyl glycol, and 3-methyl-1,5-pentanediol.

The constituent monomer of the amorphous segment contains a monomer having an odd number of carbon atoms in the main chain in an amount of preferably from 1% by mass to 50% by mass relative to the amorphous segment, more preferably from 3% by mass to 40% by mass, and particularly preferably from 5% by mass to 30% by mass. When the content is less than 1% by mass, the effect of the odd monomer may not be obtained. When the content is greater than 50% by mass, the solubility to a solvent, of a resin containing the odd monomer in the structural unit thereof may degrade. A content in the particularly preferable range is advantageous in low temperature fixability and pigment dispersibility.

The melting point of the copolymer is not particularly limited, and may be appropriately selected according to the purpose. However, it is preferably from 50° C. to 75° C. When the melting point is lower than 50° C., the copolymer may be likely to melt at a low temperature, which may degrade the heat resistant storage stability of the toner. When the melting point is higher than 75° C., the copolymer may not sufficiently melt when heated during fixing, which may degrade the low temperature fixability of the toner.

——Copolymerization——

The method for producing the copolymer is not particularly limited, and an appropriate method may be selected according to the purpose. Examples thereof include any of the methods (1) to (3) below. In terms of the degree of latitude in the molecular design, the methods (1) and (3) are preferable, and (1) is more preferable.

(1) A method of copolymerizing an amorphous segment (amorphous resin) prepared in advance by a polymerization reaction, and a crystalline segment (crystalline resin) prepared in advance by a polymerization reaction by dissolving or dispersing them in an appropriate solvent, and allowing them to undergo a reaction with an elongation agent having two or more functional groups that can react with a hydroxyl group at the terminals of the polymer chains such as an isocyanate group, an epoxy group, and a carbodiimide group, or with a carboxylic acid.

(2) A method of preparing the copolymer by melting and kneading an amorphous segment prepared in advance by a polymerization reaction and a crystalline segment prepared in advance by a polymerization reaction and allowing them to undergo a transesterification reaction at reduced pressure.

(3) A method of using a hydroxyl group of a crystalline segment prepared in advance by a polymerization reaction as a polymerization initiation component, and ring-opening an amorphous segment with the terminal of the polymer chain of the crystalline segment to thereby copolymerize them.

The elongation agent is preferably polyisocyanate.

Examples of the polyisocyanate include diisocyanate.

Examples of the diisocyanate include aromatic diisocyanate, aliphatic diisocyanate, alicyclic diisocyanate, and aromatic aliphatic diisocyanate.

Examples of the aromatic diisocyanate include 1,3-phenylene diisocyanate, 1,4-phenylene diisocyanate, 2,4-tolylene diisocyanate (TDI), 2,6-tolylene diisocyanate (TDI), crude TDI, 2,4'-diphenylmethane diisocyanate (MDI), 4,4'-diphenylmethane diisocyanate (MDI), crude MDI, 1,5-naphthylene diisocyanate, 4,4',4"-triphenylmethane triisocyanate, m-isocyanatophenylsulfonyl isocyanate, p-isocyanatophenylsulfonyl isocyanate.

Examples of the aliphatic diisocyanate include ethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2, 6-diisocyanatomethylcaproate, bis(2-isocyanatoethyl)fumarate, bis(2-isocyanatoethyl)carbonate, and 2-isocyanatoethyl-2,6-diisocyanatohexanoate.

Examples of the alicyclic diisocyanate include isophorone diisocyanate (IPDI), dicyclohexylmethane-4,4'-diisocyanate (hydrogengated MDI), cyclohexylene diisocyanate, methylcyclohexylene diisocyanate (hydrogenated TDI), bis(2-isocyanatoethyl)-4-cyclohexene-1,2-dicarboxylate, 2,5-norbornane diisocyanate, and 2,6-norbornane diisocyanate.

Examples of the aromatic aliphatic diisocyanate include m-xylylene diisocyanate (XDI), p-xylylene diisocyanate (XDI), α,α,α',α'-tetramethylxylylene diisocyanate (TMXDI).

The amount of use of the polyisocyanate when producing the copolymer is not particularly limited, and may be appropriately selected according to the purpose. However, it is preferably from 0.35 to 0.7, when expressed as a ratio of the total molar number of hydroxyl groups in the crystalline segment and the amorphous segment to the total molar number of isocyanate groups of the polyisocyanate (OH/NCO). When the OH/NCO is less than 0.35, the amorphous segment and the crystalline segment may not link sufficiently, and a large amount of the components may be left independent, which may make it impossible to secure stability of the quality. When OH/NCO is greater than 0.7, the influences of the molecular weight of the copolymerization segment and an interaction between urethane groups may be too strong, which may make it impossible to secure sufficient flowability and deformability when flowability is necessary.

The mass ratio between the crystalline segment and the amorphous segment in the copolymer (amorphous segment/crystalline segment) is not particularly limited, and may be appropriately selected according to the purpose. However, it is preferably from 1.5 to 4.0.

When the mass ratio is less than 1.5, the crystalline segment may be too predominant, which may destroy a microphase-separated structure specific to a copolymer to thereby result in a lamella structure on the whole. Such a structure effectively contributes to situations where flowability is required such as during fixing, but on the other hand, in situations where flowability and deformability are not required such as during storage or in a conveying step in the apparatus after fixing, it may be impossible to constrain the mobility of such a structure.

When the mass ratio is greater than 4.0, the amorphous segment may be too predominant. This may effectively contribute to situations where flowability and deformability are required such as during storage or in a conveying step in the apparatus after fixing, but on the other hand, in situations where flowability is not required such as during fixing, it may be impossible to secure sufficient flowability and deformability.

The molar ratio between the crystalline segment and the amorphous segment in the copolymer (crystalline segment/amorphous segment) is not particularly limited, and may be appropriately selected according to the purpose. However, it is preferably from 10/90 to 40/60. when the molar ratio is in the preferable range, advantageously, it is possible to recover hardness on an image quickly.

The molar number of the crystalline segment and the molar number of the amorphous segment when calculating the molar ratio can be obtained according to the formula below. In Examples to be described below, which are the embodiments of the present invention, the molar number of the crystalline segment and the molar number of the amorphous segment were calculated according to the following method.

$$\text{Molar number}=(\text{mass } (g) \text{ of the resin}\times\text{OHV}/56.11)/1,000$$

Here, OHV represents a hydroxyl value, and the unit thereof is mgKOH/g.

The content of the copolymer in the binder resin is not particularly limited, and may be appropriately selected according to the purpose. However, it is preferably from 50% by mass to 100% by mass, more preferably from 70% by mass to 100% by mass, and particularly preferably from 85% by mass to 100% by mass.

<Other Components>

Examples of the other components include a crystalline resin, a colorant, a releasing agent, a charge controlling agent, and an external additive.

—Crystalline Resin—

The crystalline resin, as one component of the binder resin, is not particularly limited, and an appropriate one may be selected according to the purpose. Examples thereof include the crystalline segment explained for the copolymer.

—Colorant—

The colorant is not particularly limited, and an appropriate one may be selected according to the purpose. Examples thereof include a pigment.

Examples of the pigment include a black pigment, a yellow pigment, a magenta pigment, and a cyan pigment. Among these, the colorant is preferably any of the yellow pigment, the magenta pigment, and the cyan pigment.

The black pigment is used for, for example, a black toner. Examples of the black pigment include carbon black, copper oxide, manganese dioxide, aniline black, active charcoal, non-magnetic ferrite, magnetite, a nigrosine dye, and iron black.

The yellow pigment is used for, for example, a yellow toner. Examples of the yellow pigment include C.I. Pigment Yellow 74, 93, 97, 109, 128, 151, 154, 155, 166, 168, 180, and 185, Naphthol yellow S, Hansa yellow (10G, 5G, G), cadmium yellow, yellow iron oxide, yellow ocher, chrome yellow, titanium yellow, and polyazo yellow.

The magenta pigment is used for, for example, a magenta toner. Examples of the magenta pigment include a quinacridone-based pigment, and a monoazo pigment such as C.I. Pigment Red 48:2, 57:1, 58:2, 5, 31, 146, 147, 150, 176, 184, and 269. The monoazo pigment may be used in combination with the quinacridone-based pigment.

The cyan pigment is used for, for example, a cyan toner. Examples of the cyan toner include a Cu-phthalocyanine pigment, a Zn-phthalocyanine pigment, and an Al-phthalocyanine pigment.

The content of the colorant is not particularly limited, and may be appropriately selected according to the purpose. However, it is preferably from 1 part by mass to 15 parts by mass, and more preferably from 3 parts by mass to 10 parts by mass relative to 100 parts by mass of the toner. When the content is less than 1% by mass, the coloring property of the toner may degrade. When the content is greater than 15% by mass, the pigment may not be dispersed well in the toner, which may degrade the coloring property and electric properties of the toner.

The colorant may be used in the form of a master batch in which it is combined with a resin. Examples of the resin to be produced as the master batch or to be kneaded with the master batch include: styrene polymer and substitution products thereof (e.g., polystyrene, poly-p-chlorostyrene, and polyvinyl toluene); styrene-based copolymers (e.g., styrene-p-chlorostyrene copolymer, styrene/propylene copolymer, styrene/vinyl toluene copolymer, styrene/vinyl naphthaline copolymer, styrene/methyl acrylate copolymer, styrene/ethyl acrylate copolymer, styrene/butyl acrylate copolymer, styrene/octyl acrylate copolymer, styrene/methyl methacrylate copolymer, styrene/ethyl methacrylate copolymer, styrene/butyl methacrylate copolymer, styrene/methyl α-chloromethacrylate copolymer, styrene/acrylonitrile copolymer, styrene/vinyl methyl ketone copolymer, styrene/butadiene copolymer, styrene/isoprene copolymer, styrene/acrylonitrile/indene copolymer, styrene/maleic acid copolymer, and styrene/maleic acid ester copolymer); polymethyl methacrylate; polybutyl methacrylate; polyvinyl chloride; polyvinyl acetate; polyethylene; polypropylene; polyester; epoxy resin; epoxy polyol resin; polyurethane; polyamide; polyvinyl butyral; polyacrylic acid resin; rosin; modified rosin; terpene resin; aliphatic or alicyclic hydrocarbon resin; aromatic petroleum resin; chlorinated paraffin; and paraffin wax. One of these may be used alone, or two or more of these may be used in combination.

The master batch can be obtained by mixing and kneading the resin for master batch and the colorant under a high shearing force. In this case, it is possible to use an organic solvent in order to enhance the interaction between the colorant and the resin. Furthermore, it is preferable to use a so-called flushing technique of mixing and kneading an aqueous paste of the colorant containing water with the resin and an organic solvent to transfer the colorant to the resin, and removing the water component and the organic solvent component, because there is no need of drying, as the wet cake of the colorant can be used as is.

For mixing and kneading, a high shearing disperser such as a 3-roll mill is preferably used.

For the toner, it is preferable that the colorant (particularly, the pigment) be present within the toner, and it is more preferable that it be dispersed within the toner.

For the toner, it is preferable that the colorant (particularly, the pigment) be not present in the surface of the toner.

—Releasing Agent—

The releasing agent is not particularly limited, and an appropriate one may be selected according to the purpose. Examples thereof include carbonyl group-containing wax, polyolefin wax, and long-chain hydrocarbon. One of these may be used alone, or two or more of these may be used in combination. Among these, carbonyl group-containing wax is preferable.

Examples of the carbonyl group-containing wax include polyalkanoic acid ester, polyalkanol ester, polyalkanoic acid amide, polyalkyl amide, and dialkyl ketone.

Examples of the polyalkanoic acid ester include carnauba wax, montan wax, trimethylolpropane tribehenate, pentaerythritol tetrabehenate, pentaerythritol diacetate dibehenate, glycerin tribehenate, and 1, 18-octadecanediol distearate.

Examples of the polyalkanol ester include tristearyl trimellitate, and distearyl maleate.

Examples of the polyalkanoic acid amide include dibehenyl amide.

Examples of the polyalkyl amide include trimellitic acid tristearylamide.

Examples of the dialkyl ketone include distearyl ketone.

Among these carbonyl group-containing waxes, polyalkanoic acid ester is particularly preferable.

Examples of the polyolefin wax include polyethylene wax, and polypropylene wax.

Examples of the long-chain hydrocarbon include paraffin wax, and Sasol wax.

The melting point of the releasing agent is not particularly limited, and may be appropriately selected according to the purpose. However, it is preferably from 50° C. to 100° C., and more preferably from 60° C. to 90° C. When the melting point is lower than 50° C., it may adversely affect the heat resistant storage stability. When the melting point is higher than 100° C., cold offset may be likely to occur during fixing at a low temperature.

The melting point of the releasing agent can be measured with, for example, differential scanning calorimeters (TA-60WS and DSC-60, manufactured by Shimadzu Corporation). First, the releasing agent (5.0 mg) is put in a sample vessel made of aluminum, and the sample vessel is placed on a holder unit and set in an electric furnace. Then, under a nitrogen atmosphere, the temperature is raised from 0° C. to 150° C. at a temperature raising rate of 10° C./min, and after this, the temperature is lowered from 150° C. to 0° C. at a temperature lowering rate of 10° C./min. After this, the temperature is again raised to 150° C. at a temperature raising rate of 10° C./min, and a DSC curve is measured. From the obtained DSC curve, the temperature of the maximum peak of the heat of melting during the second temperature raising can be obtained as the melting point, with an analysis program in the DSC-60 system.

The melt viscosity of the releasing agent is preferably from 5 mPa·sec to 100 mPa·sec, more preferably from 5 mPa·sec to 50 mPa·sec, and particularly preferably from 5 mPa·sec to 20 mPa·sec, as values measured at 100° C. When the melt viscosity is less than 5 mPa·sec, releasability may degrade. When the melt viscosity is greater than 100 mPa·sec, hot offset resistance and releasability at a low temperature may degrade.

The content of the releasing agent is not particularly limited, and may be appropriately selected according to the purpose. However, it is preferably from 1 part by mass to 20 parts by mass, and more preferably from 3 parts by mass to 10 parts by mass relative to 100 parts by mass of the toner. When the content is less than 1 part by mass, hot offset resistance may degrade. When the content is greater than 20 parts by mass, heat resistant storage stability, charging ability, transferability, and stress resistance may degrade.

—Charge Controlling Agent—

The charge controlling agent is not particularly limited, and an appropriate one may be selected according to the purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus or phosphorus compounds, tungsten or tungsten compounds, fluorine active agents, metal salts of salicylic acid, and metal salts of salicylic acid derivatives. Specific examples include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these manufactured by ORIENT CHEMICAL INDUSTRIES CO., LTD); quaternary ammonium salt molybdenum complex TP-302 and TP-415 (both manufactured by Hodogaya Chemical Co., Ltd.); and LRA-901 and boron complex LR-147 (manufactured by Japan Carlit Co., Ltd.).

The content of the charge controlling agent is not particularly limited, and may be appropriately selected according to the purpose. However, it is preferably from 0.01 parts by mass to 5 parts by mass, and more preferably from 0.02 parts by mass to 2 parts by mass relative to 100 parts by mass of the toner. When the content is less than 0.01 parts by mass, a charge rising property and an amount of static buildup may not be sufficient, which may influence toner images. When the content is greater than 5 parts by mass, the toner may be excessively charged to have a great electrostatic suctioning force with respect to a developing roller, which may result in degradation of the flowability of the developer or degradation of image density.

—External Additive—

The external additive is not particularly limited, and an appropriate one may be selected according to the purpose. Examples thereof include silica, fatty acid metal salt, metal oxide, hydrophobized titanium oxide, and fluoropolymer Examples of the fatty acid metal salt include zinc stearate, and aluminum stearate.

Examples of the metal oxide include titanium oxide, aluminum oxide, tin oxide, and antimony oxide.

Examples of commercially available products of the silica include R972, R974, RX200, RY200, R202, R805, and R812 (all manufactured by Nippon Aerosil Co., Ltd.).

Examples of commercially available products of the titanium oxide include P-25 (manufactured by Nippon Aerosil Co., Ltd.), STT-30 and STT-65C-S (both manufactured by Titan Kogyo, Ltd.), TAF-140 (manufactured by Fuji Titanium Industry Co., Ltd.), and MT-150W, MT-500B, MT-600B, and MT-150A (all manufactured by Tayca Corporation).

Examples of commercially available products of the hydrophobized titanium oxide include T-805 (manufactured by Nippon Aerosil Co., Ltd.), STT-30A and STT-65 S-S (both manufactured by Titan Kogyo, Ltd.), TAF-500T and TAF-1500 T (both manufactured by Fuji Titanium Industry Co., Ltd.), MT-100S and MT-100T (both manufactured by Tayca Corporation), and IT-S (Ishihara Sangyo Kaisha Ltd.)

The hydrophobizing method may be, for example, to treat hydrophilic particles with a silane coupling agent such as methyl trimethoxy silane, methyl triethoxy silane, and octyl trimethoxy silane.

The content of the external additive is not particularly limited, and may be appropriately selected according to the purpose. However, it is preferably from 0.1 parts by mass to 5 parts by mass, and more preferably from 0.3 parts by mass to 3 parts by mass relative to 100 parts by mass of the toner.

The average particle diameter of primary particles of the external additive is not particularly limited and may be appropriately selected according to the purpose. However, it is preferably 100 nm or less, and more preferably from 3 nm to 70 nm. When the average particle diameter is less than 3 nm, the external additive may be buried in the toner and not be able to exert its function effectively. When the average particle diameter is greater than 100 nm, the external additive may damage the surface of a photoconductor unevenly.

The volume average particle diameter of the toner is not particularly limited, and may be appropriately selected according to the purpose. However, it is preferably from 0.1 μm to 16 μm. The upper limit is more preferably 11 μm, and particularly preferably 9 μm. The lower limit is more preferably 0.5 μm, and particularly preferably 1 μm.

The ratio of the volume average particle diameter of the toner to the number average particle diameter thereof [volume average particle diameter/number average particle diameter] is not particularly limited, and may be appropriately selected according to the purpose. However, it is preferably from 1.0 to 1.4, and more preferably from 1.0 to 1.3 in terms of particle diameter uniformity.

The volume average particle diameter (Dv) and the number average particle diameter (Dn) are measured according to a Coulter counter procedure. Examples of the measuring instrument include COULTER COUNTER TA-II, COULTER MULTISIZER II, and COULTER MULTISIZER III (all manufactured by Beckman Coulter Inc.) The measuring procedure will be described below.

As a dispersant, a surfactant (preferably, alkylbenzene sulfonic acid salt) (from 0.1 mL to 5 mL) is added to an electrolyte aqueous solution (from 100 mL to 150 mL). The electrolyte solution is prepared as an about 1% by mass NaCl aqueous solution of primary sodium chloride, and may be, for example, ISOTON-II (manufactured by Beckman Coulter Inc.). Then, a measurement sample (from 2 mg to 20 mg) is further added thereto. The electrolyte solution in which the sample is suspended is dispersed with an ultrasonic disperser for about 1 minute to 3 minutes. With the measuring instrument described above and a 100 μm aperture, the volume and the number of the toner particles or the toner are measured, and a volume distribution and a number distribution are calculated. The volume average particle diameter and the number average particle diameter of the toner can be calculated from the obtained distributions.

Channels to be used are 13 channels, namely channels of 2.00 μm or greater but less than 2.52 μm; 2.52 μm or greater but less than 3.17 μm; 3.17 μm or greater but less than 4.00 μm; 4.00 μm or greater but less than 5.04 μm; 5.04 μm or greater but less than 6.35 μm; 6.35 μm or greater but less than 8.00 μm; 8.00 μm or greater but less than 10.08 μm; 10.08 μm or greater but less than 12.70 μm; 12.70 μm or greater but less than 16.00 μm; 16.00 μm or greater but less than 20.20 μm; 20.20 μm or greater but less than 25.40 μm; 25.40 μm or greater but less than 32.00 μm; and 32.00 μm or greater but less than 40.30 μm. The target particles are of a particle diameter of from 2.00 μm or greater but less than 40.30 μm.

<Properties Measured According to Large Amplitude Oscillatory Shear (LAOS) Procedure>

It is preferable that the toner have a sufficient mobility when flowability thereof is required such as during fixing, and have its mobility sufficiently constrained when flowability thereof is not required such as in a conveying step in the apparatus after the fixing.

The present inventors consider it important to survey from the viewpoint of rheology, the constraining of the mobility of the system in the temperature lowering process after fixing. However, because a melt receives a great strain and a great strain velocity in the process in which it cools and solidifies, the system cannot be characterized only by the conventional equilibrium structure and linear viscoelasticity. Therefore, it is necessary to discuss the system based on nonlinear viscoelasticity under a great strain. A rheological method for evaluating the system under a great train may be to apply a shear strain or to apply a uniaxial tensile strain. In consideration of the target process, it is necessary to perform evaluation according to the former method (i.e., application of a shear strain). As the procedure for this, a large amplitude oscillatory shear (LAOS) procedure, with which it is possible to discuss the system by dividing a stress value corresponding to a strain into an elastic stress and a viscous stress, is suitable.

As the result of earnest studies, the present inventors have found that in the objective of solving the problems in the image forming process, a maximum elastic stress value (ES100) obtained by a LAOS measurement at 100° C. can be used as a value assuming a fixing process. The present inventors have also found that a maximum elastic stress value at 70° C. (ES70) when the temperature is lowered from 100° C. to 70° C. can be used as a value assuming a conveying step immediately after fixing.

The value ES100 of the resin for a toner assuming fixing is 1,000 Pa or less. When the value ES100 is greater than 1,000 Pa, a property indispensable for low temperature fixing, i.e., a property of quickly absorbing an external force and quickly and freely deforming conformally to the shape of the target of fixing, is lost.

On the other hand, the value ES70 of the resin for a toner assuming a conveying step immediately after fixing is 1,000 Pa or greater. When the value ES70 is less than 1,000 Pa, the material cannot have its mobility constrained by autoagglutination or the like immediately after being melt, and cannot resist external forces (e.g., compressive sliding and separation) that are generated in the conveying step.

The value ES100 is preferably from 1 Pa to 500 Pa, and more preferably from 1 Pa to 100 Pa. The value ES100 in the more preferable range is advantageous in terms of low temperature fixing.

The value ES70 is preferably from 2,000 Pa to 200,000 Pa, and more preferably from 3,000 Pa to 200,000 Pa. The ES70 in the more preferable range is advantageous in terms of sheet discharging scratch resistance.

The value ES100 of the toner assuming fixing is preferably 3,000 Pa or less. When the value ES100 is greater than 3,000 Pa, a property indispensable for low temperature fixing, namely, a property of quickly absorbing an external force and quickly and freely deforming conformally to the shape of the target of fixing, may be lost.

On the other hand, the value ES70 assuming a conveying step immediately after fixing is preferably 5,000 Pa or greater. When the value ES70 is less than 5,000 Pa, the material may not be able to have its mobility constrained by autoagglutination or the like immediately after being melt, and may not be able to resist external forces (e.g., compressive sliding and separation) that are generated in the conveying step.

The value ES70 is more preferably from 5,000 Pa to 200,000 Pa, and particularly preferably from 10,000 Pa to 20,000 Pa. The value ES70 in the particularly preferable range is advantageous in terms of sheet discharging scratch resistance.

<<Measuring Method by Large Amplitude Oscillatory Shear Flow (LAOS)>>

For example, ARES-G2 manufactured by TA Instruments Inc. may be used to perform measurement according to the LAOS procedure. In Examples described below, which are the embodiments of the present invention, the measurement are performed according to the following procedure with the instrument described above. Toner particles or particles of the resin for a toner (0.2 g) are molded with a compression molder under a pressure of 25 MPa, into a pellet having a diameter of 1.0 mm, and this pellet is used as a sample. The measurement is performed after the pellet is set on an aluminum disposable parallel plate having a diameter of 8 mm, heated to 130° C. to be plasticized, and compressed to a predetermined gap, and any melt that overflows from the geometry is trimmed with a spurtle made of brass or the like. A measurement gap is 2 mm, an angular frequency is 1 rad/s, and an amount of strain is from 1.0% to 200%. Measurement temperatures are 100° C. and 70° C. After the measurement at 100° C. is completed, the same sample is air-cooled to 70° C. and measured.

<Properties Measured According to Pulse NMR (Nuclear Magnetic Resonance)>

One of the essential features of the present invention is a technique of constraining a molecular mobility of a crystalline segment by chemically bonding the crystalline segment with an amorphous segment and controlling the structures of the respective segments.

Pulse NMR (hereinafter may be referred to as "pulse technique NMR") is effective for indexing molecular mobility. The pulse technique NMR does not provide chemical shift information (e.g., a local chemical structure), unlike high resolution NMR. Instead, the pulse technique NMR can quickly measure relaxation times (a spin-lattice relaxation time (T1), and a spin-spin relaxation time (T2)) of a 1H nucleus that is closely related to molecular mobility, and has become widespread recently. Examples of measurement procedures of the pulse technique NMR include a Hahn echo procedure, a solid echo procedure, a CPMG procedure (Carr Purcell Meiboom Gill procedure), and a 90° pulse procedure. Any of them can be used suitably. Because the toner of the present invention has a middle-level spin-spin relaxation time (T2) at 70° C. and 130° C., the Hahn echo procedure is the most suitable, whereas because the toner of the present invention has a relatively short relaxation time at 50° C. during temperature raising, the solid echo procedure is the most suitable. Generally, the solid echo procedure and the 90° pulse procedure are suitable for the measurement of a short T2, the Hahn echo procedure is suitable for the measurement of a middle-level T2, and the CPMG procedure is suitable for the measurement of a long T2.

In the present invention, a spin-spin relaxation time (t50) at 50° C. is specified as an index of molecular mobility pertinent to storage stability, a spin-spin relaxation time (t130) at 130° C. is specified as an index of molecular mobility pertinent to fixing, and a spin-spin relaxation time (t'70) at 70° C. when the temperature is lowered from 130° C. to 70° C. is specified as an index of molecular mobility pertinent to scratch resistance while an image is conveyed.

When these specified values fall within a specific range, it is meant that the material has a sufficient mobility when flowability is required such as during fixing, and the mobility thereof is sufficiently constrained when flowability is not required such as during storage and conveying in the apparatus.

The values t50, t130, and t'70 of the resin for a toner will be explained.

The value t50, which is the index of molecular mobility pertinent to storage stability, is preferably 1.0 ms or less. When the value t50 is greater than 1.0 ms, the toner is likely to deform or aggregate under an external force because the mobility of the toner at 50° C. is high, which may make overseas shipment and storage of the toner during a summertime or by sea difficult.

The value t130, which is the index of molecular mobility pertinent to a fixing property, is preferably 8.0 ms or greater. When the value t130 is less than 8.0 ms, the flowability and deformability of the toner may be poor because the molecular mobility thereof when it is heated is insufficient. This may lead to degradation of image ductility, and degradation of bonding with a print target material, which in turn may lead to degradation of image qualities, such as degradation of glossiness and separation of the image.

The value t'70, which is the index of molecular mobility pertinent to scratch resistance while an image is conveyed, is preferably 1.5 ms or less. When the value t'70 is greater than 1.5 ms, the toner may contact or frictionally slide with a roller, a conveying member, etc. in a sheet discharging step after fixing before the molecular mobility is constrained sufficiently, which may unfavorably generate a scar on the surface of the image or change the glossiness of the image.

The value t50 of the resin for a toner is more preferably from 0.001 ms to 0.7 ms. The value t50 in the more preferable range is advantageous in terms of heat resistant storage stability and white void in the image due to aggregation.

The value t130 of the resin for a toner is more preferably from 8.0 ms to 30 ms. The value t130 in the more preferable range is advantageous in terms of low temperature fixing.

The value t'70 of the resin for a toner is more preferably from 0.05 ms to 1.5 ms. The value t'70 in the more preferable range is advantageous in terms of sheet separability during discharging.

The values t50, t130, and t'70 of the toner will be explained.

The value t50, which is the index of molecular mobility pertinent to storage stability, is preferably 1.0 ms or less. When the value t50 is greater than 1.0 ms, the toner is likely to deform or aggregate under an external force because the mobility of the toner at 50° C. is high, which may make overseas shipment and storage of the toner during a summertime or by sea difficult.

The value t130, which is the index of molecular mobility pertinent to a fixing property, is preferably 8.0 ms or greater. When the value t130 is less than 8.0 ms, the flowability and deformability of the toner may be poor because the molecular mobility thereof when it is heated is insufficient. This may lead to degradation of image ductility, and degradation of bonding with a print target material, which in turn may lead to degradation of image qualities, such as degradation of glossiness and separation of the image.

The value t'70, which is the index of molecular mobility pertinent to scratch resistance while an image is conveyed, is preferably 2.0 ms or less. When the value t'70 is greater than 2.0 ms, the toner may contact or frictionally slide with a roller, a conveying member, etc. in a sheet discharging step after fixing before the molecular mobility is constrained sufficiently, which may unfavorably generate a scar on the surface of the image or change the glossiness of the image.

The value t50 of the toner is more preferably from 0.001 ms to 0.7 ms. The value t50 in the more preferable range is advantageous in terms of heat resistant storage stability and white void in the image due to aggregation.

The value t130 of the toner is more preferably from 8.0 ms to 30 ms. The value t130 in the more preferable range is advantageous in terms of low temperature fixing.

The value t'70 of the toner is more preferably from 0.05 ms to 1.5 ms. The value t'70 in the more preferable range is advantageous in terms of sheet separability during discharging.

<<Measurement Method Using Pulse Technique NMR>>

This measurement can be preformed with, for example, "MINISPEC-MQ20" manufactured by Bruker Optics K.K.

In Examples described below, which are the embodiments of the present invention, the measurement is performed according to the following procedure with the instrument described above. The measurement is performed with an observation nucleus of 1H, at a resonance frequency of 19.65 MHz, and at measurement intervals of 5 s. An attenuation curve of t50 is measured according to a solid echo procedure, and attenuation curves of the others are measured according to a Hahn echo procedure, with a pulse sequence (90° x-Pi-180° x). Note that Pi is varied from 0.01 msec. to 100 msec., the number of data points is 100 points, a cumulative number is 32, and the measurement temperature is changed from 50° to 130° C. to 70° C.

As a sample, toner particles (0.2 g) or particles of the resin for a toner (0.2 g) are put in a dedicated sample tube, and measured with the sample tube inserted up to an appropriate range of a magnetic field. Through this measurement, a spin-spin relaxation time (t50) at 50° C., a spin-spin relaxation time (t130) at 130° C., and a spin-spin relaxation time (t'70) at 70° C. when the temperature is lowered from 130° C. to 70° C. of each sample are measured.

The solid echo procedure that focuses on a hard component is suitable for the measurement of the value t50, because this measurement focuses on a component that is hard and has a short relaxation time.

The Hahn echo procedure that focuses on a component that is soft and has a long relaxation time is suitable for the measurement of the value t130 and the measurement of the value t'70, because the former focuses on the mobility of the system on the whole, and the latter focuses on the constraining of the mobility of the system on the whole when cooled.

<Properties Measured According to AFM>

It is preferable that a binarized image of the resin for a toner, which is obtained by binarizing a phase image thereof observed with a tapping mode AFM with an intermediate value between a maximum phase difference and a minimum phase difference in the phase image, include first phase difference images formed by portions having a large phase difference and second phase difference images formed by portions having a small phase difference, that the first phase difference images be dispersed in each of the second phase difference images, and that the first phase difference images have a dispersion diameter of 100 nm or less.

It is preferable that a binarized image of the toner, which is obtained by binarizing a phase image thereof observed with a tapping mode AFM with an intermediate value between a maximum phase difference and a minimum phase difference in the phase image, include first phase difference images formed by portions having a large phase difference and second phase difference images formed by portions having a small phase difference, and that the first phase difference images be dispersed in each of the second phase difference images. Further, the average (dispersion diameter) of the maximum Feret diameters, in the disperse phase, of the first phase difference images formed by the portions having a large phase difference is preferably 200 nm or less, and more preferably from 10 nm to 100 nm. Note that there may also be cases where the portions having a small phase are linked with each other linearly, and it is impossible to detect the demarcation between them. In that case, it is only necessary that the width of the line be 200 nm or less.

In the present invention, what is meant by the first phase difference images being dispersed in each of the second phase difference images is that in the binarized image, boundaries can be defined between domains, and the first phase difference images have a definable Feret diameter in the disperse phase. When the first phase difference images in the binarized image represent minute particle diameters that are difficult to discriminate between an image noise or a phase difference image, or when a clear Feret diameter cannot be defined, the structure is judged as "not being dispersed". When the first phase difference images are buried in image noises to make it impossible for the domains to be bounded, no Feret diameter can be defined.

Note that only when a domain has a stripe shape, and the maximum Feret diameter thereof is 300 nm or greater, the minimum Feret diameter thereof is used as the domain diameter instead of the maximum Feret diameter.

In order to improve the toughness of the binder resin, it is necessary to introduce a structure for relaxing deformation or a stress from outside, into the resin. The means for obtaining this may be to introduce a softer structure. However, in this case, it is likely for blocking, in which toner particles fuse with each other during storage, to occur, or for damages or adhesion to an image to occur due to the softness. In order to satisfy toughness and a relaxing property at the same time, it is necessary to resolve this trade-off relationship between them.

The present inventors have found it possible to resolve the trade-off relationship between the toughness and the relaxing property of the resin, by imparting to the resin, a structure in which the first phase difference images formed by the portions having a large phase difference, which may be able to effectively affect stress relaxation and improve the toughness, are minutely dispersed in the phase of the second phase difference images formed by the portions having a small phase difference.

<<AFM Measurement Procedure>>

The internal dispersed state of the toner or the resin for a toner can be confirmed from phase images obtained according to a tapping mode of an atomic force microscope (AFM). A tapping mode of an atomic force microscope is a procedure described in Surface Science Letter, 290, 668 (1993). According to this procedure, a shape of a sample surface is measured while vibrating a cantilever, as described in, for example, Polymer, 35, 5778 (1994), Macromolecules, 28, 6773 (1995), etc. During this process, a phase difference may occur between a drive, which is the vibration source of the cantilever, and the actual vibration, depending on the viscoelastic property of the sample surface. A phase image is a mapping of this phase difference. A large phase lag occurs at a soft portion, and a small phase lag is observed at a hard portion.

It is preferable that in the toner or in the resin for a toner, portions that are observed as a large phase difference image and portions that are hard and observed as a small phase difference image be dispersed minutely. In this case, it is preferable that the second phase difference images formed by the hard and small phase difference portions be minutely dispersed as an external phase, and the first phase difference images formed by the soft and large phase difference portions as an internal phase.

In Examples described below, which are the embodiments of the present invention, AFT measurement is performed with the following instrument and according to the following procedure.

The sample from which to obtain a phase image is a slice of a block of the toner or the resin for a toner obtained by cutting with an ultramicrotome ULTRACUT UCT manufactured by Lica Corporation under the conditions below. Observation is performed with this slice.

Cutting thickness: 60 nm

Cutting speed: 0.4 mm/sec

With a diamond knife (ULTRA SONIC 35°)

A representative instrument for obtaining an AFM phase image is, for example, MFP-3D manufactured by Asylum Technology Co., Ltd. A cantilever may be, for example, OMCL-AC240TS-C3. In Examples, this instrument is used. The measurement conditions are as follows.

Target amplitude: 0.5 V
Target percent: −5%
Amplitude setpoint: 315 mV
Scan rate: 1 Hz
Scan points: 256×256
Scan angle: 0°

Figure 3:
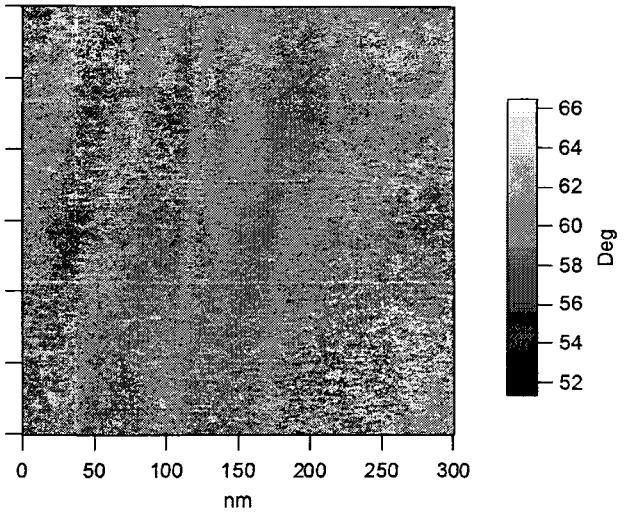
FIG. 3 shows an example of a minute diameter image which can hardly be discriminated between an image noise or a phase difference image.

In a specific method for obtaining an average of the maximum Feret diameters of the first phase difference images formed by the portions having a large phase difference in the phase image obtained with the AFM, the phase image obtained with the tapping mode AFM is binarized with an intermediate value between the maximum phase difference and the minimum phase difference in the phase image. As described above, the binarized image is obtained by capturing a phase image to have a contrast such that small phase difference portions are deep and large phase difference portions are pale, and binarizing the phase image using an intermediate value between the maximum phase difference and the minimum phase difference in the phase image as a boundary. In the binarized image, 30 first phase difference images that have the largest maximum Feret diameters are selected in the descending order from 10 images that are within a 300 nm square range, and the average of these largest maximum Feret diameters is used as the average of the maximum Feret diameters. However, a minute diameter image (see FIG. 3) that is definitely judged as an image noise, or difficult to discriminate between an image noise or a phase difference image is excluded from the calculation of the average diameter. Specifically, a first phase difference image that has an area ratio of equal to or less than 1/100 of a first phase difference image that is present in the same observed phase image and has the largest maximum Feret diameter is not used for the calculation of the average diameter. A maximum Feret diameter is the largest possible distance between two parallel lines between which a phase difference image can be sandwiched.

The average (dispersion diameter) of the maximum Feret diameters of the resin for a toner is preferably 100 nm or less, and more preferably from 10 nm to 100 nm. When the average (dispersion diameter) of the maximum Feret diameters is greater than 100 nm, a highly adhesive unit is likely to be exposed under a stress, which may degrade the filming property of the toner. When the average (dispersion diameter) of the maximum Feret diameters is less than 10 nm, the degree of stress relaxation may be significantly low, and the effect of improving the toughness may be insufficient.

Figure 2:
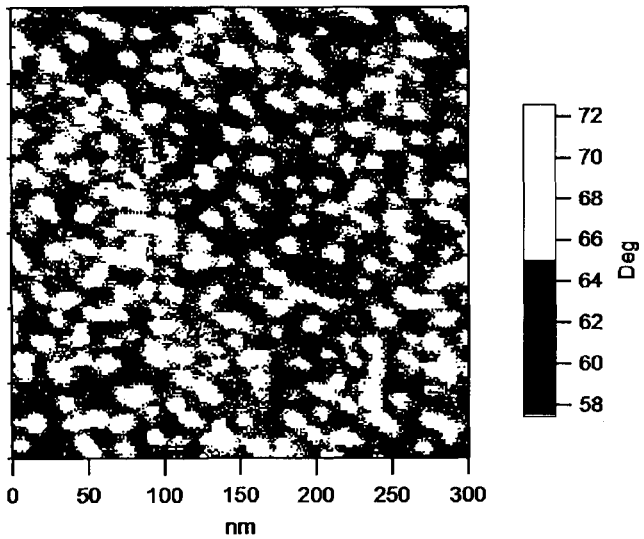
FIG. 2 shows a binarized image obtained by binarizing the phase image of FIG. 1.

For reference, FIG. 1 shows an example of a phase image of a toner using the copolymer. FIG. 2 shows a binarized image obtained by binarizing this phase image as above. In FIG. 2, bright regions are the first phase difference images (images where the phase difference is large) formed by the portions having a large phase difference, and dark regions are the second phase difference images (images where the phase difference is small) formed by the portions having a small phase difference.

Note that only when a domain has a stripe shape, and the maximum Feret diameter thereof is 300 nm or greater, the minimum Feret diameter thereof is used as the domain diameter instead of the maximum Feret diameter.

<Molecular Weight of Copolymer>

The weight average molecular weight (Mw) of the copolymer is preferably 20,000 to 150,000 in terms of realizing the various properties described above and satisfying low temperature fixability and heat resistant storage stability at the same time.

When Mw is less than 20,000, the heat resistant storage stability, and the hot offset resistance of the toner may degrade. When Mw is greater than 150,000, the toner may not melt sufficiently particularly during fixing at a low temperature, which may degrade the low temperature fixability of the toner because an image may be likely to peel.

The Mw can be measured with a gel permeation chromatography (GPC) measuring instrument (e.g., HLC-8228GPC (manufactured by Tosoh Corporation)). As columns, three continuous 15 cm columns TSKGEL SUPER HZM-H (manufactured by Tosoh Corporation) are used. The resin to be measured is prepared as a 0.15% by mass solution in tetrahydrofuran (THF) (containing a stabilizing agent, manufactured by Wako Pure Chemical Industries, Ltd.), and this solution is filtered through a 0.2 μm filter. The obtained filtrate is used as a sample. The THF sample solution (100 μL) is injected into the measuring instrument, and measured at a temperature of 40° C. at a flow rate of 0.35 mL/minute.

The molecular weight is calculated with calibration curves generated based on monodisperse polystyrene standard samples. The monodisperse polystyrene standard samples are SHOWDEX STNDARD SERIES manufactured by Showa Denko K.K. and toluene. THF solutions of the following three kinds of monodisperse polystyrene standard samples are made, and measured under the conditions described above. Calibration curves are generated by regarding a retention time of peak tops as light-scattering molecular weights of the monodisperse polystyrene standard samples.

Solution A: S-7450 (2.5 mg), S-678 (2.5 mg), S-46.5 (2.5 mg), S-2.90 (2.5 mg), and THF (50 mL)

Solution B: S-3730 (2.5 mg), S-257 (2.5 mg), S-19.8 (2.5 mg), S-0.580 (2.5 mg), and THF (50 mL)

Solution C: S-1470 (2.5 mg), S-112 (2.5 mg), S-6.93 (2.5 mg), toluene (2.5 mg), and THF (50 mL)

The detector to be used is a RI (refraction index) detector.

<Method for Producing Toner>

The method for producing the toner is not particularly limited, and an appropriate method may be selected according to the purpose. Example methods include a wet granulation method and a pulverization method. Examples of the wet granulation method include a dissolution suspension method and an emulsion aggregation method. The dissolution suspension method and the emulsion aggregation method, which are methods involving no kneading of a binder resin because of a risk of molecular disconnections due to kneading and difficulty with uniformly kneading a high molecular weight resin and a low molecular weight resin, are preferable, and the dissolution suspension method is more preferable in terms of uniformity of the resin in the toner particles.

The toner can also be produced by a particle production method as described in JP-B No. 4531076, i.e., a particle production method of obtaining toner particles by dissolving the constituent materials of the toner in liquid or supercritical carbon dioxide, and then removing the liquid or supercritical carbon dioxide.

—Dissolution Suspension Method—

An example of the dissolution suspension method may include a toner material phase preparing step, an aqueous medium phase preparing step, an emulsion or dispersion liquid preparing step, and an organic solvent removing step, and may further include other steps according to necessity.

——Toner Material Phase (Oil Phase) Preparing Step——

The toner material phase preparing step is not particularly limited, and an appropriate step may be selected according to the purpose, as long as it is a step of dissolving or dispersing in an organic solvent, toner materials containing at least the binder resin, and further containing the colorant, the releasing agent, etc. according to necessity to thereby prepare a dissolved or dispersed liquid of the toner materials (may also be referred to as toner material phase or oil phase).

The organic solvent is not particularly limited, and an appropriate one may be selected according to the purpose. However, a volatile organic solvent that has a boiling point of lower than 150° C. is preferable because such a solvent can be removed easily.

Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Among these, ethyl acetate, toluene, xylene, benzene, methylene chloride, 1,2-dichloroethane, chloroform, and carbon tetrachloride are preferable, and ethyl acetate is more preferable.

One of these may be used alone, or two or more of these may be used in combination.

The amount of use of the organic solvent is not particularly limited, and may be appropriately selected according to the purpose. However, it is preferably from 0 part by mass to 300 parts by mass, more preferably from 0 part by mass to 100 parts by mass, and particularly preferably from 25 parts by mass to 70 parts by mass relative to 100 parts by mass of the toner materials.

——Aqueous Medium Phase (Water Phase) Preparing Step——

The aqueous medium phase preparing step is not particularly limited, and an appropriate step may be selected according to the purpose, as long as it is a step of preparing an aqueous medium phase. In this step, it is preferable to prepare an aqueous medium phase, which is an aqueous medium in which resin particles are contained.

The aqueous medium is not particularly limited, and an appropriate one may be selected according to the purpose. Examples thereof include water, a solvent miscible with water, and a mixture of them. Among these, water is particularly preferable.

The solvent miscible with the water is not particularly limited, and an appropriate one may be selected according to the purpose, as long as it is miscible with water. Examples thereof include alcohol, dimethylformamide, tetrahydrofuran, cellosolves, and lower ketones.

Examples of the alcohol include methanol, isopropanol, and ethylene glycol.

Examples of the lower ketones include acetone, and methyl ethyl ketone.

One of these may be used alone, or two or more of these may be used in combination.

The aqueous medium phase is prepared by, for example, dispersing the resin particles in the aqueous medium in the presence of a surfactant. The surfactant, the resin particles, etc. are arbitrarily added to the aqueous medium, in order to improve dispersion of the toner materials.

The additive amounts of the surfactant and the resin particles to the aqueous medium are not particularly limited, and may be appropriately selected according to the purpose. However, they are each preferably from 0.5% by mass to 10% by mass relative to the aqueous medium.

The surfactant is not particularly limited, and an appropriate one may be selected according to the purpose. Examples thereof include an anionic surfactant, a cationic surfactant, and an amphoteric surfactant.

Examples of the anionic surfactant include fatty acid salt, alkyl sulfuric acid ester salt, alkyl aryl sulfonic acid salt, alkyl diaryl ether disulfonic acid salt, dialkyl sulfosuccinic acid salt, alkyl phosphoric acid salt, naphthalene sulfonic acid formalin condensate, polyoxyethylene alkyl phosphoric acid ester salt, and glyceryl borate fatty acid ester.

The resin particles may be of any resin, as long as the resin can form an aqueous dispersion, and may be of a thermoplastic resin or a thermosetting resin. Examples of the material of the resin particles include a vinyl-based resin, a polyurethane resin, an epoxy resin, a polyester resin, a polyamide resin, a polyimide resin, a silicon-based resin, a phenol resin, a melamine resin, a urea resin, an aniline resin, an ionomer resin, and a polycarbonate resin. One of these may be used alone, or two or more of these may be used in combination.

Among these, a vinyl-based resin, a polyurethane resin, an epoxy resin, a polyester resin, and a combination of them is preferable, because an aqueous dispersion of fine spherical resin particles can be easily obtained with them.

Examples of the vinyl-based resin include a polymer obtained by homo-polymerizing a vinyl-based monomer or by copolymerizing vinyl-based monomers, such as a styrene/(meth)acrylic acid ester copolymer, a styrene/butadiene copolymer, a (meth)acrylic acid/acrylic acid ester copolymer, a styrene/acrylonitrile copolymer, a styrene/maleic anhydride copolymer, and a styrene/(meth)acrylic acid copolymer.

The average particle diameter of the resin particles is not particularly limited, and may be appropriately selected according to the purpose. However, it is preferably from 5 nm to 200 nm, and more preferably from 20 nm to 300 nm.

In the preparation of the aqueous medium phase, cellulose may be used as a dispersant. Examples of the cellulose include methyl cellulose, hydroxyethyl cellulose, hydroxypropyl cellulose, and carboxymethyl cellulose sodium.

——Emulsion or Dispersion Liquid Preparing Step——

The emulsion or dispersion liquid preparing step is not particularly limited, and an appropriate step may be selected according to the purpose, as long as it is a step of mixing a dissolved or dispersed liquid of the toner materials (toner material phase) with the aqueous medium phase, and emulsifying or dispersing the former to thereby prepare an emulsion or dispersion liquid.

The method for emulsification or dispersion is not particularly limited, and an appropriate method may be selected according to the purpose. For example, emulsification or dispersion may be performed with a publicly-known disperser. Examples of the disperser include a low speed shearing disperser, and a high speed shearing disperser.

The amount of use of the aqueous medium phase relative to 100 parts by mass of the toner material phase is not particularly limited, and may be appropriately selected according to the purpose. However, it is preferably from 50 parts by mass to 2,000 parts by mass, and more preferably from 100 parts by mass to 1,000 parts by mass. When the amount of use is less than 50 parts by mass, the toner material phase may not be dispersed well, which may make it impossible to obtain toner particles having a predetermined particle diameter. When the amount of use is greater than 2,000, it is not cost-effective.

——Organic Solvent Removing Step——

The organic solvent removing step is not particularly limited, and an appropriate step may be selected according to the purpose, as long as it is a step of removing the organic solvent from the emulsion or dispersion liquid to obtain a desolventized slurry.

The organic solvent may be removed, for example, by (1) a method of raising the temperature of the whole reaction system gradually to completely evaporate and remove the organic solvent included in the oil droplets of the emulsion or dispersion liquid, and (2) a method of spraying the emulsion or dispersion liquid in a dry atmosphere to completely remove the organic solvent contained in the oil droplets of the emulsion or dispersion liquid. Toner particles are formed when the organic solvent is removed.

——Other Steps——

Examples of the other steps include a cleaning step and a drying step.

———Cleaning Step———

The cleaning step is not particularly limited, and an appropriate step may be selected according to the purpose, as long as it is a step of cleaning the desolventized slurry with water after the organic solvent removing step. Examples of the water include ion-exchanged water.

———Drying Step———

The drying step is not particularly limited, and an appropriate step may be selected according to the purpose, as long as it is a step of drying the toner particles obtained in the cleaning step.

—Pulverization Method—

The pulverization method is a method of, for example, producing base particles of the toner by pulverizing and classifying a product obtained by melt-kneading the toner materials containing at least a binder resin.

The melt-kneading is performed by charging a melt-kneader with a mixture obtained by mixing the toner materials. Examples of the melt-kneader include a uniaxial or biaxial continuous kneader, and a batch type kneader with a roll mill. Specific examples include KTK BIAXIAL EXTRUDER manufactured by Kobe Steel Ltd., TEM EXTRUDER manufactured by Toshiba Machine Co., Ltd., BIAXIAL EXTRUDER manufactured by KCK Co., PCM BIAXIAL EXTRUDER manufactured by Ikegai Corp., and CO-KNEADER manufactured by Buss Inc. It is preferable to perform the melt-kneading under appropriate conditions that would not bring about disconnections of the molecular chains of the binder resin. Specifically, the melt-kneading temperature is determined based on the softening point of the binder resin. When the melt-kneading temperature is much higher than the softening point, there may occur severe disconnections. When the melt-kneading temperature is much lower than the softening point, dispersion may not advance.

The pulverizing is a step of pulverizing the kneaded product obtained from the melt-kneading. In this pulverizing, it is preferable to coarsely pulverize the kneaded product first, and finely pulverize it next. In this case, a method of pulverizing the kneaded product by making it collide on an impact board in a jet air stream, a method of pulverizing the kneaded product by making particles collide on themselves in a jet air stream, or a method of pulverizing the kneaded product within a narrow gap between a mechanically rotating rotor and a stator.

The classifying is a step of adjusting the pulverized product obtained from the pulverizing to particles having a predetermined particle diameter. The classifying can be performed by, for example, removing fine particles with a cyclone, a decanter, a centrifuge, etc.

(Developer)

A developer of the present invention contains the toner of the present invention. The developer may be used as a one-component developer, or may be mixed with a carrier and used as a two-component developer. Of these, the two-component developer is preferable for use in a fast printer, etc., that are adapted to the recent years' improvement in the information processing speed, in terms of enhancement of the life.

With the one-component developer using the toner, it is possible to obtain favorable and stable developability and images even after a long term of use (stirring) in the developing unit, because there may be little variation in the particle diameter of the toner even after consumption and replenishment of the toner, the toner may not be filmed over a developing roller, and the toner may not melt and adhere to a layer thickness regulating member such as a blade for making the toner into a thin layer.

With the two-component developer using the toner, it is possible to obtain favorable and stable developability even after a long term of stirring in the developing unit, because there may be little variation in the particle diameter of the toner in the developer even after consumption and replenishment of the toner over a long term.

<Carrier>

The carrier is not particularly limited, and an appropriate one may be selected according to the purpose. However, one that contains a core material and a resin layer covering the core material is preferable.

<<Core Material>>

The core material is not particularly limited, and an appropriate one may be selected according to the purpose, as long as it is particles having a magnetic property. Preferably examples thereof include ferrite, magnetite, iron, and nickel. Further, in consideration of adaptability to environmental concerns that have been increased in the recent years, the ferrite is not the conventional copper/zinc-based ferrite, but is preferably manganese ferrite, manganese/magnesium ferrite, manganese/strontium ferrite, manganese/magnesium/strontium ferrite, and lithium-based ferrite.

<<Resin Layer>>

The material of the resin layer is not particularly limited, and an appropriate one may be selected according to the purpose. Examples thereof include an amino-based resin, a polyvinyl-based resin, a polystyrene-based resin, an olefin halide resin, a polyester-based resin, a polycarbonate-based resin, a polyethylene resin, a polyvinyl fluoride resin, a polyvinylidene fluoride resin, a polytrifluoroethylene resin, a polyhexafluoropropylene resin, a copolymer between vinylidene fluoride and an acrylic monomer, a copolymer between vinylidene fluoride and vinyl fluoride, a fluoroterpolymer such as terpolymer among tetrafluoroethylene, vinylidene fluoride, and a non-fluoride monomer, and a silicone resin. One of these may be used alone, or two or more of these may be used in combination.

The silicone resin is not particularly limited, and an appropriate one may be selected according to the purpose. Examples thereof include: a straight silicone resin composed only of an organosiloxane bond; and a modified silicone resin modified with an alkyd resin, a polyester resin, an epoxy resin, an acrylic resin, a urethane resin, etc.

The silicone resin may be a commercially available product.

Examples of the silicone resin include: KR271, KR255, and KR152 manufactured by Shin-Etsu Chemical Co., Ltd.;

and SR2400, SR2406, and SR2410 manufactured by Dow Corning Toray Silicone Co., Ltd.

Examples of the modified silicone resin include: KR206 (an alkyd-modified silicone resin), KR5208 (an acrylic-modified silicone resin), ES1001N (an epoxy-modified silicone resin), and KR305 (a urethane-modified silicone resin) manufactured by Shin-Etsu Chemical Co., Ltd.; and SR2115 (an epoxy-modified silicone resin) and SR2110 (an alkyd-modified silicone resin) manufactured by Dow Corning Toray Silicone Co., Ltd.

The silicone resin may be used alone, but may be used together with a cross-linking-reactive component, a static buildup adjusting component, etc.

The content of the constituent component of the resin layer in the carrier is preferably from 0.01% by mass to 5.0% by mass. When the content is less than 0.01% by mass, it may not be possible for the resin layer to be formed uniformly on the surface of the core material. When the content is greater than 5.0% by mass, the resin layer may be excessively thick to cause the carrier particles themselves to be granulated, which may make it impossible to obtain uniform carrier particles.

The content of the toner in the developer, in the case where it is a two-component developer, is not particularly limited and may be appropriately selected according to the purpose. However, it is preferably from 2.0 parts by mass to 12.0 parts by mass, and more preferably from 2.5 parts by mass to 10.0 parts by mass relative to 100 parts by mass of the carrier.

(Image Forming Apparatus, and Image Forming Method)

An image forming apparatus of the present invention includes at least an electrostatic latent image bearing member (hereinafter may be referred to as "photoconductor"), an electrostatic latent image forming unit, and a developing unit, and further includes other units according to the necessity.

An image forming method of the present invention includes at least an electrostatic latent image forming step and a developing step, and further includes other steps according to the necessity.

The image forming method can be preferably carried out by the image forming apparatus. The electrostatic latent image forming step can be preferably performed by the electrostatic latent image forming unit. The developing step can be preferably performed by the developing unit. The other steps can be preferably performed by the other units.

<Electrostatic Latent Image Bearing Member>

The electrostatic latent image bearing member are not particularly limited in terms of material, structure, and size, and an appropriate one may be selected from publicly-known ones. In terms of material, examples thereof include an inorganic photoconductor made of amorphous silicon, selenium, etc., and an organic photoconductor made of polysilane, phthalopolymethine, etc. Among these, amorphous silicon is preferable because it has a long life.

The amorphous photoconductor may be a photoconductor obtained by heating a support to 50° C. to 400° C., and forming a photoconductive layer made of a-Si on the support according to a film forming method such as vacuum vapor deposition, sputtering, ion plating, thermal CVD (Chemical Vapor Deposition), optical CVD, plasma CVD, etc. Among these, plasma CVD, i.e., a method of decomposing a material gas by means of a direct-current, or high-frequency, or microwave glow discharge, and forming an a-Si deposition film on the support is preferable.

The shape of the electrostatic latent image bearing member is not particularly limited, and may be appropriately selected according to the purpose. However, a cylindrical shape is preferable. The outer diameter of the cylindrical electrostatic latent image bearing member is not particularly limited, and may be appropriately selected according to the purpose. However, it is preferably from 3 mm to 10 mm, more preferably from 5 mm to 50 mm, and particularly preferably from 10 mm to 30 mm.

<Electrostatic Latent Image Forming Unit, and Electrostatic Latent Image Forming Step>

The electrostatic latent image forming unit is not particularly limited, and an appropriate one may be selected according to the purpose, as long as it is a unit configured to form an electrostatic latent image on the electrostatic latent image bearing member. Examples thereof include a unit that includes at least a charging member configured to electrically charge the surface of the electrostatic latent image bearing member, and an exposing member configured to expose the surface of the electrostatic latent image bearing member to light imagewise.

The electrostatic latent image forming step is not particularly limited, and an appropriate step may be selected according to the purpose, as long as it is a step of forming an electrostatic latent image on the electrostatic latent image bearing member. For example, this step may be performed by electrically charging the surface of the electrostatic latent image bearing member, and then exposing the surface to light imagewise, and can be performed by the electrostatic latent image forming unit.

<<Charging Member and Charging>>

The charging member is not particularly limited, and an appropriate one may be selected according to the purpose. Examples thereof include a contact charging device publicly-known per se including an electroconductive or semi-conductive roller, a brush, a film, a rubber blade, etc., and contactless charging device utilizing a corona discharge, such as a corotron, and a scrotron.

The charging can be performed by, for example, applying a voltage to the surface of the electrostatic latent image bearing member with the charging member.

The charging member may have the shape of a roller, and other than this, may have any shape such as of a magnetic brush, a far brush, etc. The shape may be selected according to the specifications and formation of the image forming apparatus.

When a magnetic brush is used as the charging member, the magnetic brush may be constituted by particles of any kind of ferrite, such as Zn—Cu ferrite, which are used as a charging material, which is borne on a non-magnetic electroconductive sleeve, within which a magnet roll is embraced.

When a fur brush is used as the charging member, the material of the far brush is a fur that is treated to have electroconductivity with, for example, carbon, copper sulfide, metal, or metal oxide. The charging member can be formed by winding or pasting this fur around or to a metal or any other cored bar that is treated to have electroconductivity.

The charging member is not limited to the contact charging members described above. However, it is preferable to use a contact charging member, because with which, an image forming apparatus with reduced ozone to be produced from a charging member can be obtained.

<<Exposing Member and Exposing>>

The exposing member is not particularly limited, and an appropriate one may be selected according to the purpose, as long as it can expose the surface of the electrostatic latent image bearing member electrically charged by the charging member to light imagewise like the image to be formed. Examples thereof include various types of exposing members such as a copier optical system, a rod lens array system, a laser optical system, and liquid crystal shutter optical system.

The light source used for the exposing member is not particularly limited, and an appropriate one may be selected according to the purpose. Examples thereof include all kinds of light-emitting members such as a fluorescent lamp, a tungsten lamp, a halogen lamp, a mercury lamp, a sodium-vapor lamp, a light-emitting diode (LED), a laser diode (LD), and electroluminescence.

In order to apply light of only a desired wavelength range, it is also possible to use various kinds of filters such as a sharp cut filter, a band pass filter, a near-infrared cut filter, a dichroic filter, an interference filter, and a color conversion filter.

The exposing can be performed by exposing the surface of the electrostatic latent image bearing member to light imagewise with the exposing member.

In the present invention, it is also possible to employ a backlighting system that is configured to apply light from the back side of the electrostatic latent image bearing member imagewise.

<Developing Unit and Developing Step>

The developing unit is not particularly limited, and an appropriate one may be selected according to the purpose, as long as it is a developing unit containing a toner and configured to develop the electrostatic latent image formed on the electrostatic latent image bearing member and form a visible image.

The developing step is not particularly limited, and an appropriate step may be selected according to the purpose, as long as it is a step of developing the electrostatic latent image formed on the electrostatic latent image bearing member with a toner and forming a visible image. The step can be performed by, for example, the developing unit.

The developing unit may be of a dry developing system, or a wet developing system. Further, it may be of a single-color developing unit or a multi-color developing unit.

A developing device that includes: a stirrer configured to frictionally stir the toner and electrically charge the toner; and a developer bearing member which includes a magnetic field generating unit fixed thereinside and is rotatable with a developer containing the toner borne on the surface thereof is preferable as the developing unit.

In the developing unit, for example, the toner and the carrier are mixed and stirred, and the toner gets electrically charged due to the mixing and stirring friction to be thereby retained on the surface of a rotating magnet roller in a chain-like form and form a magnetic brush. The magnet roller is provided near the electrostatic latent image bearing member. Therefore, part of the toner constituting the magnetic brush formed on the surface of the magnet roller is moved to the surface of the electrostatic latent image bearing member by means of an electric attractive force. As a result, the electrostatic latent image is developed with the toner, and a visible image made of the toner is formed on the surface of the electrostatic latent image bearing member.

<Other Units and Other Steps>

Examples of the other units include a transfer unit, a fixing unit, a cleaning unit, a charge eliminating unit, a recycling unit, and a control unit.

Examples of the other steps include a transfer step, a fixing step, a cleaning step, a charge eliminating step, a recycling step, and a control step.

<<Transfer Unit and Transfer Step>>

The transfer unit is not particularly limited, and an appropriate one may be selected according to the purpose as long as it is a unit configured to transfer a visible image onto a recording medium. However, it is preferably one that includes a first transfer unit configured to transfer a visible image onto an intermediate transfer member and form a combined transfer image thereon, and a second transfer unit configured to transfer the combined transfer image onto a recording medium.

The transfer step is not particularly limited, and an appropriate step may be selected according to the purpose, as long as it is a step of transferring a visible image onto a recording medium. However, it is preferably a step that uses an intermediate transfer member, to firstly transfer a visible image onto the intermediate transfer member, and then secondly transfer the visible image onto a recording medium.

The transfer step can be performed by, for example, electrically charging the visible image or the photoconductor with a transfer charging device, and can be performed by the transfer unit.

Here, when the image to be secondly transferred onto the recording medium is a color image made up of toners of a plurality of colors, it is possible for the transfer unit to sequentially overlay toners of the respective colors on the intermediate transfer member to form images on the intermediate transfer member, and for the intermediate transfer member to secondly transfer the images on the intermediate transfer member onto the recording medium simultaneously.

The intermediate transfer member is not particularly limited, and an appropriate one may be selected according to the purpose from publicly-known transfer mediums. A preferable example thereof is a transfer belt.

It is preferable that the transfer unit (the first transfer unit and the second transfer unit) include at least a transfer device configured to electrically charge the visible image formed on the photoconductor so as to be separated onto the recording medium. Examples of the transfer device include a corona transfer device utilizing a corona discharge, a transfer belt, a transfer roller, a pressure transfer roller, and an adhesive transfer device.

A representative example of the recording medium is a regular sheet. However, the recording medium is not particularly limited, and an appropriate one may be selected according to the purpose, as long as it is one to which a developed non-fixed image can be transferred. A PET base for OHP, etc. may also be used.

<<Fixing Unit and Fixing Step>>

The fixing unit is not particularly limited, and an appropriate one may be selected according to the purpose, as long as it is a unit configured to fix a transfer image transferred onto the recording medium thereon. However, a publicly-known heating/pressuring member is preferable. Examples of the heating/pressurizing member include a combination of a heating roller and a pressurizing roller, and a combination of a heating roller, a pressurizing roller, and an endless belt.

The fixing step is not particularly limited, and an appropriate step may be selected according to the purpose as long as it is a step of fixing a visible image transferred onto the recording medium thereon. For example, this step may be performed separately for each color of toner when the toner is transferred onto the recording medium, or may be performed simultaneously at a time for all colors of toners in their overlaid state.

The fixing step can be performed by the fixing unit.

Typically, heating by the heating/pressurizing member is preferably from 80° C. to 200° C.

In the present invention, according to the purpose, a publicly-known optical fixing device may be used together with or instead of the fixing unit described above.

The surface pressure in the fixing step is not particularly limited, and may be appropriately selected according to the purpose. However, it is preferably from 10 $N/cm^2$ to 80 $N/cm^2$.

<<Cleaning Unit and Cleaning Step>>

The cleaning unit is not particularly limited, and an appropriate one may be selected according to the purpose, as long as it is a unit capable of removing the toner remained on the photoconductor. Examples thereof include a magnetic brush cleaner, an electrostatic brush cleaner, a magnetic roller cleaner, a blade cleaner, a brush cleaner, and a web cleaner.

The cleaning step is not particularly limited, and an appropriate step may be selected according to the purposed, as long as it is a step capable of removing the toner remained on the photoconductor. This step can be performed by, for example the cleaning unit.

<<Charge Eliminating Unit and Charge Eliminating Step>>

The charge eliminating unit is not particularly limited, and an appropriate one may be selected according to the purpose, as long as it is a unit configured to eliminate charges by applying a charge eliminating bias to the photoconductor. Examples thereof include a charge eliminating lamp.

The charge eliminating step is not particularly limited, and an appropriate step may be selected according to the purpose, as long as it is a step of eliminating charges by applying a charge eliminating bias to the photoconductor. This step can be performed by, for example, the charge eliminating unit.

<<Recycling Unit and Recycling Step>>

The recycling unit is not particularly limited, and an appropriate one may be selected according to the purpose, as long as it is a unit configured to recycle the toner removed in the cleaning step to the developing device. Examples thereof include a publicly-known conveying unit.

The recycling step is not particularly limited, and an appropriate step may be selected according to the purpose, as long as it is a step of recycling the toner removed in the cleaning step to the developing device. This step can be performed by, for example the recycling unit.

<<Control Unit and Control Step>>

The control unit is not particularly limited, and an appropriate unit may be selected according to the purpose, as long as it is a unit capable of controlling the operations of each unit. Examples thereof include devices such as a sequencer and a computer.

The control step is not particularly limited, and an appropriate step may be selected according to the purpose, as long as it is a step capable of controlling the operations in each step. This step can be performed by, for example the control unit.

Next, one mode of carrying out a method for forming an image with the image forming apparatus of the present invention will be described with reference to FIG. 4. The image forming apparatus 100 shown in FIG. 4 includes an electrostatic latent image bearing member 10, a charging roller 20 as the charging member, an exposing device 30 as the exposing member, a developing device 40 as the developing unit, an intermediate transfer member 50, a cleaning device 60 as the cleaning unit including a cleaning blade, and a charge eliminating lamp 70 as the charge eliminating unit.

The intermediate transfer member 50 is an endless belt, and is designed to be movable in the direction of the arrow by means of three rollers 51 that are provided inside the intermediate transfer member and tense it. Some of the three rollers 51 also function as a transfer bias roller capable of applying a predetermined transfer bias (a first transfer bias) to the intermediate transfer member 50. A cleaning device 90 having a cleaning blade is provided near the intermediate transfer member 50. A transfer roller 80, as the transfer unit capable of applying a transfer bias for transferring (secondly transferring) a developed image (a toner image) onto a transfer sheet 95 as a recording medium, is also provided near the intermediate transfer member 50 so as to face the intermediate transfer member 50. A corona charging device 58 configured to impart charges onto a toner image on the intermediate transfer member 50 is provided about the circumference of the intermediate transfer member 50, between the region where the electrostatic latent image bearing member 10 and the intermediate transfer member 50 contact each other, and a region where the intermediate transfer member 50 and the transfer sheet 95 contact each other in the rotational direction of the intermediate transfer member 50.

The developing device 40 includes a developing belt 41 as the developer bearing member, and a black developing unit 45K, a yellow developing unit 45Y, a magenta developing unit 45M, and a cyan developing unit 45C that are provided on the circumference of the developing belt 41 side by side. The black developing unit 45K includes a developer container 42K, a developer feeding roller 43K, and a developing roller 44K. The yellow developing unit 45Y includes a developer container 42Y, a developer feeding roller 43Y, and a developing roller 44Y. The magenta developing unit 45M includes a developer container 42M, a developer feeding roller 43M, and a developing roller 44M. The cyan developing unit 45C includes a developer container 42C, a developer feeding roller 43C, and a developing roller 44C. The developing belt 41 is an endless belt, is tensed by a plurality of belt rollers rotatably, and partially contacts the electrostatic latent image bearing member 10.

Figure 4:
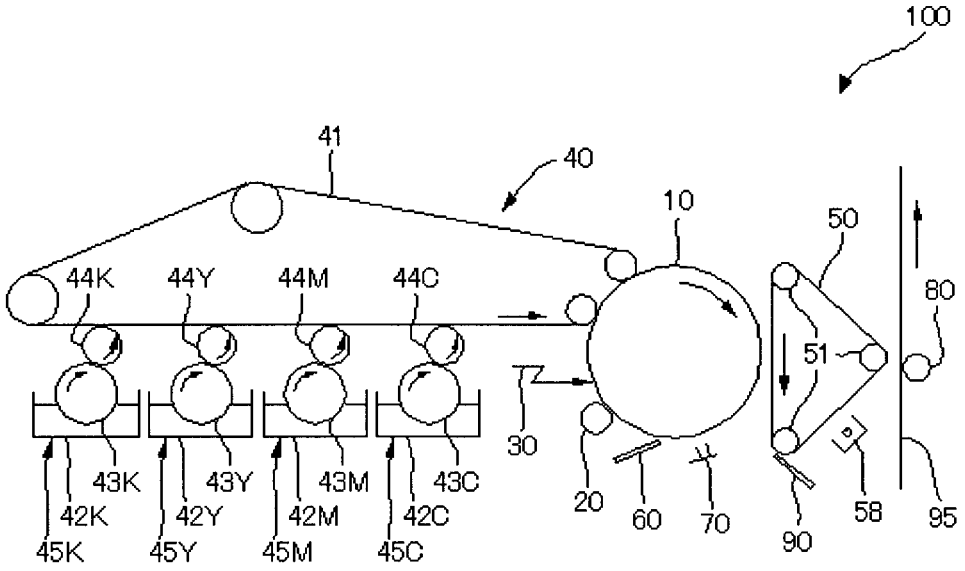
FIG. 4 is a schematic configuration diagram showing an example of an image forming apparatus of the present invention.

In the image forming apparatus 100 shown in FIG. 4, the charging roller 20 electrically charges the electrostatic latent image bearing member 10 uniformly. The exposing device 30 exposes the electrostatic latent image bearing member 10 to light imagewise to form an electrostatic latent image thereon. A toner is fed from the developing device 40 to develop the electrostatic latent image formed on the electrostatic latent image bearing member 10 and to form a toner image. The toner image is transferred (firstly transferred) onto the intermediate transfer member 50 by means of a voltage applied by the roller 51, and further transferred (secondly transferred) onto the transfer sheet 95. As a result, a transfer image is formed on the transfer sheet 95. Any residual toner on the electrostatic latent image bearing member 10 is removed by the cleaning device 60, and charges built up on the electrostatic latent image bearing member 10 are once eliminated by the charge eliminating lamp 70.

Figure 5:
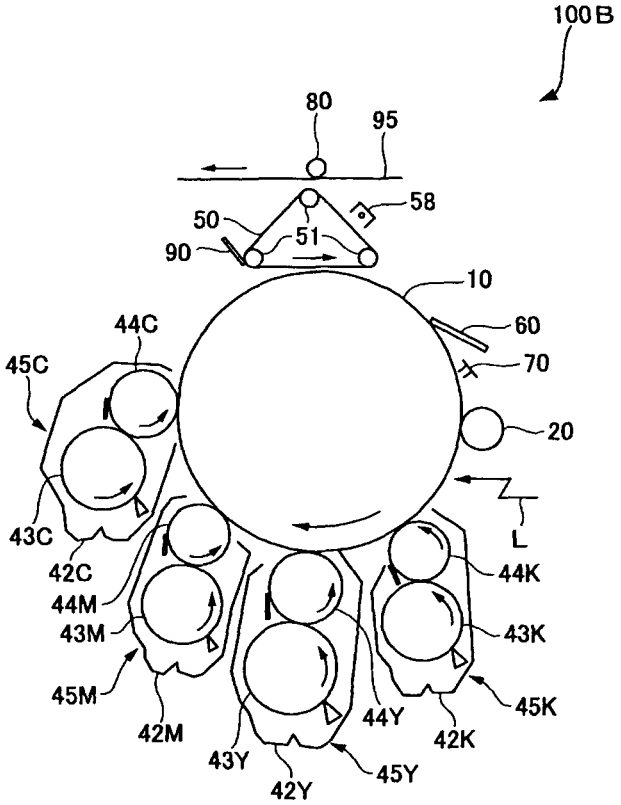
FIG. 5 is a schematic configuration diagram showing another example of an image forming apparatus of the present invention.

FIG. 5 shows another example of an image forming apparatus of the present invention. The image forming apparatus 100B has the same configuration as that of the image forming apparatus 100 shown in FIG. 4, except that it does not include a developing belt 41, and it includes a black developing unit 45K, a yellow developing unit 45Y, a magenta developing unit 45M, and a cyan developing unit 45C that are provided around an electrostatic latent image bearing member 10 so as to directly face it.

Figure 6:
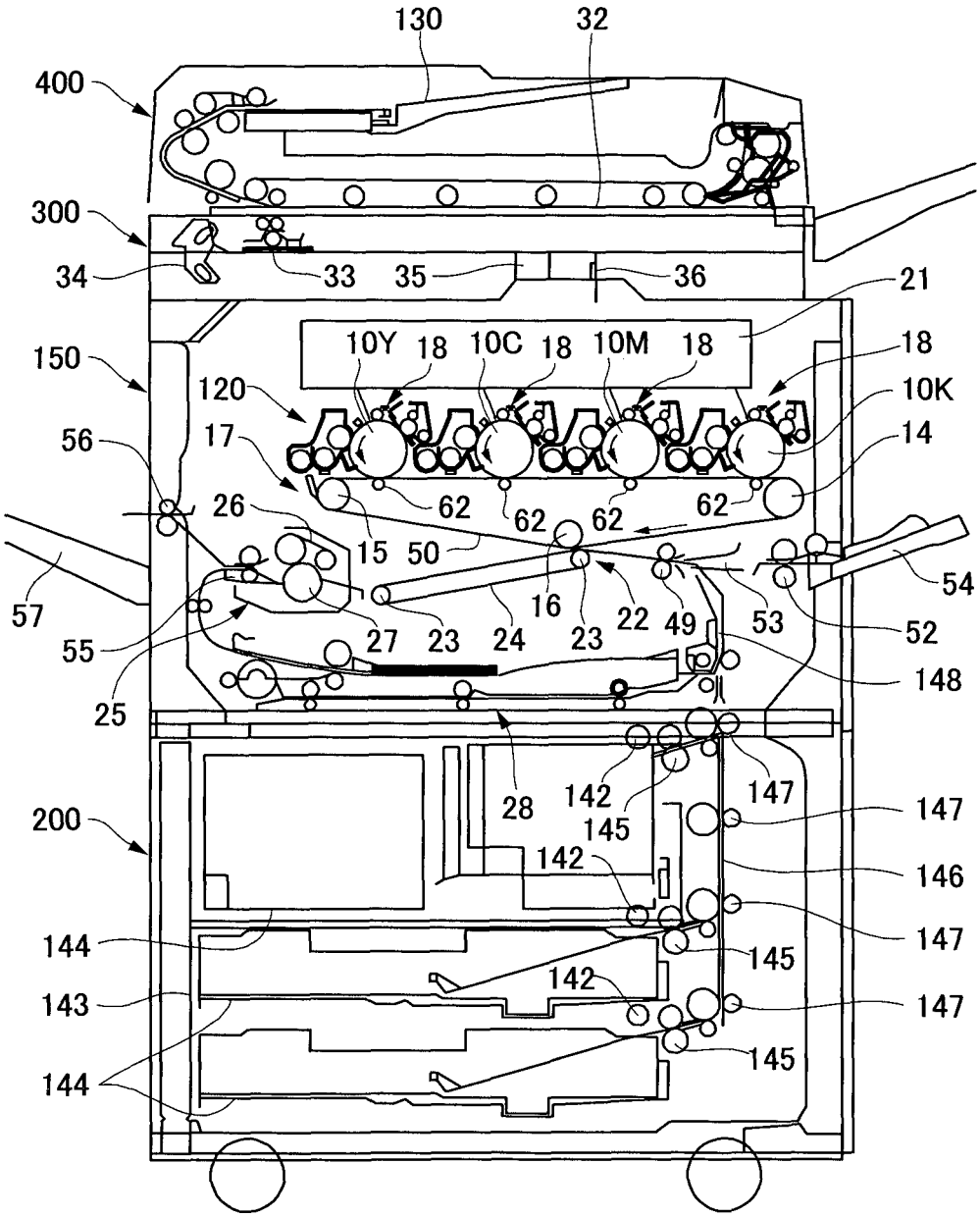
FIG. 6 is a schematic configuration diagram showing another example of an image forming apparatus of the present invention.

An image forming apparatus shown in FIG. 6 includes a copier body 150, a sheet feeding table 200, a scanner 300, and an automatic document feeder (ADF) 400.

The copier body 150 includes an endless belt-shaped intermediate transfer member 50 in the center thereof. The intermediate transfer member 50 is tensed by support rollers 14, 15, and 16, and is rotatable clockwise in FIG. 6. An intermediate transfer member cleaning device 17 configured to remove residual toner on the intermediate transfer member 50 is provided near the support roller 15. The intermediate transfer member 50 tensed by the support roller 14 and the support roller 15 is provided with a tandem developing device 120 in which four image forming units 18 for yellow, cyan, magenta, and black are arranged side by side along the conveying direction of the intermediate transfer member so as to face the intermediate transfer member. An exposing device 21 as the exposing member is provided near the tandem developing device 120. A second transfer device 22 is provided on a side of the intermediate transfer member 50 opposite to the side thereof on which the tandem developing device 120 is provided. In the second transfer device 22, a second transfer belt 24, which is an endless belt, it tensed by a pair of rollers 23. A transfer sheet conveyed over the second transfer belt 24 and the intermediate transfer member 50 can contact each other. A fixing device 25 as the fixing unit is provided near the second transfer device 22. The fixing device 25 includes a fixing belt 26, which is an endless belt, and a pressurizing roller 27 provided pressed against the fixing belt.

In the tandem image forming apparatus, a sheet overturning device 28 configured to overturn a transfer sheet so as for images to be formed on both sides of the transfer sheet is provided near the second transfer device 22 and the fixing device 25.

Next, a full-color image formation (color copying) with the tandem developing device 120 will be explained. First, a document is set on a document table 130 of the automatic document feeder (ADF) 400, or alternatively, the automatic document feeder 400 is opened, a document is set on a contact glass 32 of the scanner 300, and the automatic document feeder 400 is closed.

Upon a depression of a start switch, the scanner 300 is started after the document is conveyed onto the contact glass 32 when the document has been set on the automatic document feeder 400, or immediately upon the depression when the document has been set on the contact glass 32. Then, a first running member 33 and a second running member 34 are started to run. The document is irradiated by the first travelling member 33 with light from a light source, and light reflected from the document surface is reflected on a mirror of the second travelling member 34 to be received by a reading sensor 36 through an imaging lens 35, and read as a color document (color image), which is used as image information for black, yellow, magenta, and cyan.

Figure 7:
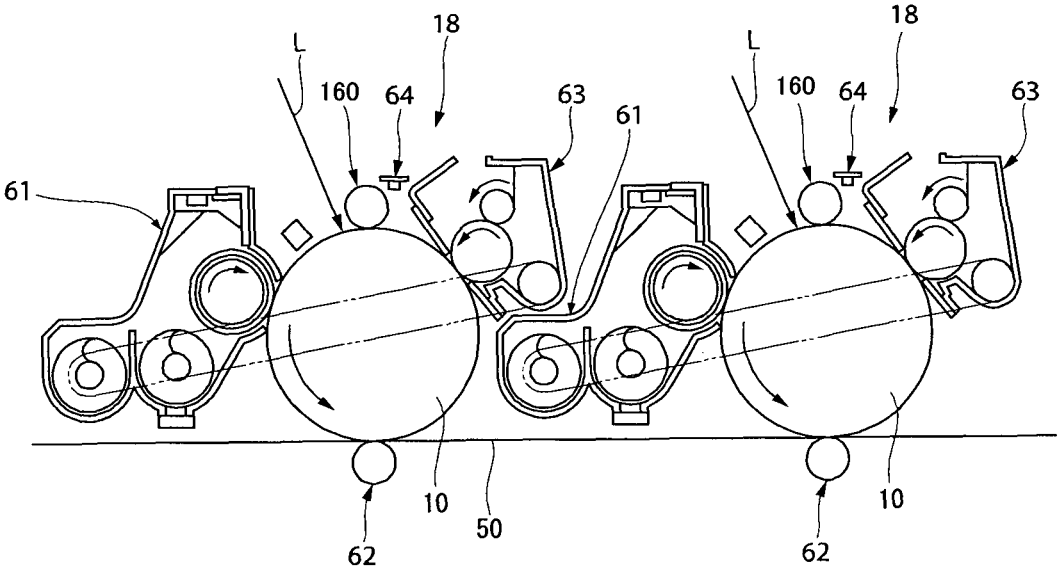
FIG. 7 is a diagram showing a portion of FIG. 6 in enlargement.

The respective pieces of image information for black, yellow, magenta, and cyan are transmitted to the image forming units 18 (a black image forming unit, a yellow image forming unit, a magenta image forming unit, and a cyan image forming unit) in the tandem developing device 120, respectively. Toner images of black, yellow, magenta, and cyan are formed in the respective image forming units. That is, the image forming units 18 (the black image forming unit, the yellow image forming unit, the magenta image forming unit, and the cyan image forming unit) in the tandem developing device 120 each include, as shown in FIG. 7, an electrostatic latent image bearing member 10 (a black electrostatic latent image bearing member 10K, a yellow electrostatic latent image bearing member 10Y, a magenta electrostatic latent image bearing member 10M, and a cyan electrostatic latent image bearing member 10C), a charging device 160 configured to electrically charge the electrostatic latent image bearing member 10 uniformly, an exposing device configured to expose the electrostatic latent image bearing member to light (L in FIG. 7) imagewise like an image corresponding to the corresponding color image based on the corresponding color image information to form an electrostatic latent image corresponding to the corresponding color image on the electrostatic latent image bearing member, a developing device 61 as the developing unit configured to develop the electrostatic latent image with a corresponding color toner (a black toner, a yellow toner, a magenta toner, and a cyan toner) to form a toner image of the corresponding color toner, a transfer charging device 62 configured to transfer the toner image onto the intermediate transfer member 50, a cleaning device 63, and a charge eliminating device 64. Each image forming unit 18 can form a single-color image of the corresponding color (a black image, a yellow image, a magenta image, and a cyan image) based on the corresponding color image information. The black image on the black electrostatic latent image bearing member 10K, the yellow image on the yellow electrostatic latent image bearing member 10Y, the magenta image on the magenta electrostatic latent image bearing member 10M, and the cyan image on the cyan electrostatic latent image bearing member 10C formed thereon in this way are sequentially transferred (first transferred) onto the intermediate transfer member 50 that is moved to rotate by the support rollers 14, 15, and 16. Then, the black image, the yellow image, the magenta image, and the cyan image are overlaid together on the intermediate transfer member 50 and formed as a combined color image (a color transfer image).

Meanwhile, in the sheet feeding table 200, one of sheet feeding rollers 142 is selectively rotated to bring forward sheets (recording sheets) from one of sheet feeding cassettes 144 provided multi-stages in a paper bank 143. The sheets are sent forward to a sheet feeding path 146 sheet by sheet separately via a separating roller 145, conveyed by a conveying roller 147 to be introduced to a sheet feeding path 148 in the copier body 150, and stopped by being struck on a registration roller 49. Alternatively, a sheet feeding roller 142 is rotated to bring forward sheets (recording sheets) on a manual sheet feeding tray 54, and the sheets are let into a manual sheet feeding path 53 sheet by sheet separately via a separating roller 52, and likewise stopped by being struck on the registration roller 49. The registration roller 49 is commonly used in an earthed state, but may be used in a biased state in order for sheet dusts from the sheets to be removed. Then, so as to be in time for the combined color image (color transfer image) combined on the intermediate transfer member 50, the registration roller 49 is rotated to send forward a sheet (recording sheet) to between the intermediate transfer member 50 and the second transfer device 22, and the combined color image (color transfer image) is transferred (secondly transferred) onto the sheet (recording sheet) by the second transfer device 22. In this way, a color image is transferred and formed on the sheet (recording sheet). Any residual toner on the intermediate transfer member 50 after transferred the image is cleaned away by the intermediate transfer member cleaning device 17.

The sheet (recording sheet) on which the color image is transferred and formed is conveyed by the second transfer device 22 and sent forward to the fixing device 25, and the combined color image (color transfer image) is fixed on the sheet (recording sheet) by the fixing device 25 with heat and pressure. After this, the sheet (recording sheet) is switched by a switching claw 55 to a discharging roller 56 so as to be discharged, and stacked on a sheet discharging tray 57. Alternatively, the sheet is switched by the switching claw 55 to a sheet overturning device 28 so as to be overturned and introduced to the transfer position again, and after having an image formed also on the back side thereof, discharged by the discharging roller 56 and stacked on the sheet discharging tray 57.

(Process Cartridge)

A process cartridge of the present invention includes at least an electrostatic latent image bearing member, and a developing unit containing a toner and configured to develop an electrostatic latent image formed on the electrostatic latent image bearing member and form a visible image, and further includes other units according to necessity.

The process cartridge can be detachably attached on the body of the image forming apparatus.

EXAMPLES

Examples of the present invention will be explained below. However, the present invention is not limited to the Examples below by any means. "Part" represents "part by mass" unless otherwise expressly. specified. "%" represents "% by mass" unless otherwise expressly specified.

<Measurement of Glass Transition Temperature and Melting Point of Resin>

The glass transition temperature and the melting point of a resin were measured with a DSC system (a differential scanning calorimeter) ("DSC-60" manufactured by Shimadzu Corporation).

Specifically, according to the following procedure, the maximum endothermic peak temperature among endothermic peak temperatures of a target sample was measured as the melting point of the resin.

From an obtained DSC curve, a DSC curve for a second temperature raising was selected with an analysis program "Endothermic Peak Temperature" of the DSC-60 system, and the endothermic peak in the second temperature raising of the target sample was obtained.

[Measurement Conditions]

Sample vessel: Sample pan made of aluminum (with a cap)

Amount of sample: 5 mg

Reference: Sample pan made of aluminum (alumina 10 mg)

Atmosphere: Nitrogen (at a flow rate of 50 mL/min)

Temperature conditions

Start temperature: 20° C.

Temperature raising rate: 10° C./min

End temperature: 150° C.

Retention time: absent

Temperature lowering rate: 10° C./min

End temperature: −20° C.

Retention time: absent

Temperature raising rate: 10° C./min

End temperature: 150° C.

Production Example 1-1

<Production of Amorphous Segment A1>

A 5 L four-necked flask equipped with a nitrogen introducing pipe, a dehydrating pipe, a stirrer, and a thermocouple was charged with propylene glycol (1,2-propanediol) and 1,3-propanediol as diols at a ratio of propylene glycol/1,3-propanediol of 95/5 (on a molar basis), with dimethyl terephthalate as a dicarboxylic acid at a molar ratio (OH/COOH) of OH group (OH group of the diols) to COOH group (COOH group of the terephthalic acid) of 1.2, and with titanium tetraisopropoxide in an amount of 300 ppm relative to the mass of the charged materials. The materials were reacted with methanol let to flow out, and kept reacted until finally the materials were warmed to 230° C. and a resin acid value became 5 mgKOH/g or less. After this, they were reacted at a reduced pressure of from 20 mmHg to 30 mmHg for 4 hours, to thereby obtain [Amorphous Segment A1], which was a linear polyester resin. (Production Example 1-2)

<Production of Amorphous Segment A2>

A 5 L four-necked flask equipped with a nitrogen introducing pipe, a dehydrating pipe, a stirrer, and a thermocouple was charged with propylene glycol and 1,3-propanediol as diols at a ratio of propylene glycol/1,3-propanediol of 90/10 (on a molar basis), with dimethyl terephthalate as a dicarboxylic acid at a molar ratio (OH/COOH) of OH group (OH group of the diols) to COOH group (COOH group of the terephthalic acid) of 1.2, and with titanium tetraisopropoxide in an amount of 300 ppm relative to the mass of the charged materials. The materials were reacted with methanol let to flow out, and kept reacted until finally the materials were warmed to 230° C. and a resin acid value became 5 mgKOH/g or less. After this, they were reacted at a reduced pressure of from 20 mmHg to 30 mmHg for 4 hours, to thereby obtain [Amorphous Segment A2], which was a linear polyester resin.

Production Example 1-3

<Production of Amorphous Segment A3>

A 5 L four-necked flask equipped with a nitrogen introducing pipe, a dehydrating pipe, a stirrer, and a thermocouple was charged with propylene glycol and 1,3-propanediol as diols at a ratio of propylene glycol/1,3-propanediol of 80/20 (on a molar basis), with dimethyl terephthalate as a dicarboxylic acid at a molar ratio (OH/COOH) of OH group (OH group of the diols) to COOH group (COOH group of the terephthalic acid) of 1.2, and with titanium tetraisopropoxide in an amount of 300 ppm relative to the mass of the charged materials. The materials were reacted with methanol let to flow out, and kept reacted until finally the materials were warmed to 230° C. and a resin acid value became 5 mgKOH/g or less. After this, they were reacted at a reduced pressure of from 20 mmHg to 30 mmHg for 4 hours, to thereby obtain [Amorphous Segment A3], which was a linear polyester resin.

Production Example 1-4

<Production of Amorphous Segment A4>

A 5 L four-necked flask equipped with a nitrogen introducing pipe, a dehydrating pipe, a stirrer, and a thermocouple was charged with propylene glycol and 1,3-propanediol as diols at a ratio of propylene glycol/1,3-propanediol of 75/25 (on a molar basis), with dimethyl terephthalate as a dicarboxylic acid at a molar ratio (OH/COOH) of OH group (OH group of the diols) to COOH group (COOH group of the terephthalic acid) of 1.2, and with titanium tetraisopropoxide in an amount of 300 ppm relative to the mass of the charged materials. The materials were reacted with methanol let to flow out, and kept reacted until finally the materials were warmed to 230° C. and a resin acid value became 5 mgKOH/g or less. After this, they were reacted at a reduced pressure of from 20 mmHg to 30 mmHg for 4 hours, to thereby obtain [Amorphous Segment A4], which was a linear polyester resin.

Production Example 1-5

<Production of Amorphous Segment A5>

A 5 L four-necked flask equipped with a nitrogen introducing pipe, a dehydrating pipe, a stirrer, and a thermocouple was charged with propylene glycol and 1,3-propanediol as diols at a ratio of propylene glycol/1,3-propanediol of 70/30 (on a molar basis), with dimethyl terephthalate as a dicarboxylic acid at a molar ratio (OH/COOH) of OH group (OH group of the diols) to COOH group (COOH group of the terephthalic acid) of 1.2, and with titanium tetraisopropoxide in an amount of 300 ppm relative to the mass of the charged materials. The materials were reacted with methanol let to flow out, and kept reacted until finally the materials were warmed to 230° C. and a resin acid value became 5 mgKOH/g or less. After this, they were reacted at a reduced pressure of from 20 mmHg to 30 mmHg for 4 hours, to thereby obtain [Amorphous Segment A5], which was a linear polyester resin.

Production Example 1-6

<Production of Amorphous Segment A6>

A 5 L four-necked flask equipped with a nitrogen introducing pipe, a dehydrating pipe, a stirrer, and a thermocouple was charged with propylene glycol and 1,3-propanediol as diols at a ratio of propylene glycol/1,3-propanediol of 50/50 (on a molar basis), with dimethyl terephthalate as a dicarboxylic acid at a molar ratio (OH/COOH) of OH group (OH group of the diols) to COOH group (COOH group of the terephthalic acid) of 1.2, and with titanium tetraisopropoxide in an amount of 300 ppm relative to the mass of the charged materials. The materials were reacted with methanol let to flow out, and kept reacted until finally the materials were warmed to 230° C. and a resin acid value became 5 mgKOH/g or less. After this, they were reacted at a reduced pressure of from 20 mmHg to 30 mmHg for 4 hours, to thereby obtain [Amorphous Segment A6], which was a linear polyester resin.

Production Example 1-7

<Production of Amorphous Segment A7>

A 5 L four-necked flask equipped with a nitrogen introducing pipe, a dehydrating pipe, a stirrer, and a thermocouple was charged with propylene glycol as a diol, and dimethyl terephthalate and dimethyl adipate as dicarboxylic acids (at a ratio of 90/10 (on a molar basis)), at a molar ratio (OH/COOH) of OH group (OH group of the diol) to COOH group (COOH group of the dicarboxylic acids) of 1.2, and with titanium tetraisopropoxide in an amount of 300 ppm relative to the mass of the charged materials. The materials were reacted with methanol let to flow out, and kept reacted until finally the materials were warmed to 230° C. and a resin acid value became 5 mgKOH/g or less. After this, they were reacted at a reduced pressure of from 20 mmHg to 30 mmHg for 4 hours, to thereby obtain [Amorphous Segment A7], which was a linear polyester resin.

Production Example 1-8

<Production of Amorphous Segment A8>

A 5 L four-necked flask equipped with a nitrogen introducing pipe, a dehydrating pipe, a stirrer, and a thermocouple was charged with propylene glycol as a diol, and dimethyl terephthalate, dimethyl adipate, and trimellitic anhydride as dicarboxylic acids (at a ratio of 87.5/18.5/4 (on a molar basis)), at a molar ratio (OH/COOH) of OH group (OH group of the diol) to COOH group (COOH group of the dicarboxylic acids) of 1.2, and with titanium tetraisopropoxide in an amount of 300 ppm relative to the mass of the charged materials. The materials were reacted with methanol let to flow out, and kept reacted until finally the materials were warmed to 230° C. and a resin acid value became 5 mgKOH/g or less. After this, they were reacted at a reduced pressure of from 20 mmHg to 30 mmHg for 4 hours, to thereby obtain [Amorphous Segment A8], which was a polyester resin.

Production Example 1-9

<Production of Amorphous Segment A9>

A 5 L four-necked flask equipped with a nitrogen introducing pipe, a dehydrating pipe, a stirrer, and a thermocouple was charged with propylene glycol and 1,3-propanediol as diols at a ratio of propylene glycol/1,3-propanediol of 80/20 (on a molar basis), with dimethyl terephthalate as a dicarboxylic acid at a molar ratio (OH/COOH) of OH group (OH group of the diols) to COOH group (COOH group of the terephthalic acid) of 1.2, and with titanium tetraisopropoxide in an amount of 300 ppm relative to the mass of the charged materials. The materials were reacted with methanol let to flow out, and kept reacted until finally the materials were warmed to 230° C. and a resin acid value became 5 mgKOH/g or less. After this, they were reacted at a reduced pressure of from 20 mmHg to 30 mmHg for 5 hours, to thereby obtain [Amorphous Segment A9], which was a linear polyester resin.

The amorphous segments A1 to A9 are summed up in Table 1.

TABLE 1

| Amorphous resin | 1,2-PO/1,3-PO (molar ratio) | AV (mgKOH/g) | OHV (mgKOH/g) | Glass transition temp. Tg (° C.) |
|---|---|---|---|---|
| Amorphous segment A1 | 95/5 | 0.55 | 42.6 | 65.2 |
| Amorphous segment A2 | 90/10 | 0.36 | 30.2 | 63.6 |
| Amorphous segment A3 | 80/20 | 0.33 | 30.4 | 61.0 |
| Amorphous segment A4 | 75/25 | 0.53 | 30.3 | 58.7 |
| Amorphous segment A5 | 70/30 | 0.42 | 30.7 | 57.6 |
| Amorphous segment A6 | 50/50 | 0.34 | 30.1 | 51.7 |
| Amorphous segment A7 | 100/0 | 1.08 | 23.3 | 59.2 |
| Amorphous segment A8 | 100/0 | 1.9 | 24 | 48.6 |
| Amorphous segment A9 | 80/20 | 0.35 | 25.7 | 64.5 |

Production Example 2-1

<Production of Crystalline Segment C1 (Crystalline Polyester Resin C1)>

A 5 L four-necked flask equipped with a nitrogen introducing pipe, a dehydrating pipe, a stirrer, and a thermocouple was charged with 1,4-butanediol as a diol and sebacic acid as a dicarboxylic acid at a molar ratio (OH/COOH) of OH group to COOH group of 1.1, and with titanium tetraisopropoxide in an amount of 300 ppm relative to the mass of the charged materials. The materials were reacted with water let to flow out, and kept reacted until finally the materials were warmed to 230° C. and a resin acid value became 5 mgKOH/g or less. After this, they were reacted at a reduced pressure of 10 mmHg or lower for 6 hours, to thereby obtain [Crystalline Segment C1], which was a crystalline polyester resin.

The obtained resin has an acid value (AV) of 0.38 mgKOH/g, a hydroxyl value (OHV) of 22.6 mgKOH/g, and Tm of 63.8° C.

Production Example 2-2

<Production of Crystalline Segment C2 (Crystalline Polyester Resin C2)>

A 5 L four-necked flask equipped with a nitrogen introducing pipe, a dehydrating pipe, a stirrer, and a thermocouple was charged with 1,6-hexanediol as a diol and adipic acid as a dicarboxylic acid at a molar ratio (OH/COOH) of OH group to COOH group of 1.1, and with titanium tetraisopropoxide in an amount of 300 ppm relative to the mass of the charged materials. The materials were reacted with water let to flow out, and kept reacted until finally the materials were warmed to 230° C. and a resin acid value became 5 mgKOH/g or less. After this, they were reacted at a reduced pressure of 10 mmHg or lower for 6 hours, to thereby obtain [Crystalline Segment C2], which was a crystalline polyester resin.

The obtained resin has an acid value (AV) of 0.9 mgKOH/g, a hydroxyl value (OHV) of 27.5 mgKOH/g, and Tm of 57.2° C.

Example 1

<Production of Block Copolymer B1>

A 5 L four-necked flask equipped with a nitrogen introducing pipe, a dehydrating pipe, a stirrer, and a thermocouple was charged with [Amorphous Segment A1] (1,400 g) and [Crystalline Segment C1] (600 g), and they were dried at 60° C. for 2 hours at a reduced pressure of 10 mmHg. After nitrogen decompression, ethyl acetate (2,000 g) dehydrated through molecular sieves 4A was added thereto to dissolve the materials under nitrogen stream until they became uniform. Next, 4,4'-diphenylmethane diisocyanate (140 g) was added to the system, and they were stirred until they became visually uniform. After this, tin 2-ethylhexanoate as a catalyst was added thereto in an amount of 100 ppm relative to the mass of the resin solid content, and they were warmed to 80° C. and reacted under a reflux for 5 hours. Next, ethyl acetate was distilled away therefrom at a reduced pressure, to thereby obtain [Block Copolymer B1].

The characteristic values of the obtained resin are shown in Table 2.

Examples 2 to 8 and Comparative Examples 1 to 4

<Production of Block Copolymers B2 to B12>

Block copolymers B2 to B12 were produced in the same manner as in Example 1, except that the amorphous segment in Example 1 was changed as shown in Table 2.

The characteristic values of the obtained resins are shown in Table 2.

TABLE 2

| | Binder resin | Amorphous segment | Crystalline segment | Crystalline segment/ amorphous segment (molar ratio) | Crystalline segment/ amorphous segment (g/g) | Melting point Tm (° C.) | LAOS ES100 (Pa) | LAOS ES70 (Pa) | Pulse NMR relaxation time (ms) t50 | t'70 | t130 | Phase image dispersion diameter (nm) |
|---|---|---|---|---|---|---|---|---|---|---|---|---|
| Ex. 1 | Block copolymer B1 | A1 | C1 | 0.19 | 30/70 | 55.2 | 56 | 3,500 | 0.055 | 0.41 | 9.0 | 60 |
| Ex. 2 | Block copolymer B2 | A2 | C1 | 0.24 | 30/70 | 57.9 | 50 | 3,200 | 0.056 | 0.53 | 9.2 | 50 |
| Ex. 3 | Block copolymer B3 | A3 | C1 | 0.24 | 30/70 | 58.1 | 48 | 3,000 | 0.055 | 0.65 | 9.1 | 50 |
| Ex. 4 | Block copolymer B4 | A4 | C1 | 0.24 | 30/70 | 58.4 | 47 | 2,600 | 0.055 | 0.72 | 9.0 | 50 |
| Ex. 5 | Block copolymer B5 | A5 | C1 | 0.24 | 30/70 | 58.8 | 40 | 2,300 | 0.055 | 0.78 | 9.3 | 50 |
| Ex. 6 | Block copolymer B6 | A6 | C1 | 0.24 | 30/70 | 59.1 | 26 | 2,100 | 0.058 | 0.82 | 9.2 | 50 |
| Ex. 7 | Block copolymer B8 | A4 | C2 | 0.28 | 30/70 | 54.3 | 45 | 2,500 | 0.053 | 0.74 | 9.1 | 50 |
| Ex. 8 | Block copolymer B10 | A9 | C1 | 0.27 | 30/70 | 58.3 | 910 | 4,500 | 0.052 | 0.45 | 9.4 | 60 |
| Comp. ex. 1 | Block copolymer B9 | A8 | C1 | 0.29 | 30/70 | 60.7 | 4,025 | 20,000 | 0.050 | 0.58 | 7.9 | 70 |
| Comp. ex. 2 | Block copolymer B11 | A8 | C1 | 0.38 | 45/55 | — | 195 | 280 | 0.080 | 1.70 | 19.0 | 80 |
| Comp. ex. 3 | Block copolymer B12 | A7 | C1 | 0.15 | 15/85 | — | 1,150 | 10,000 | 0.051 | 0.48 | 8.7 | Could not be observed |
| Comp. ex. 4 | Block copolymer B7 | A7 | C1 | 0.29 | 30/70 | — | 41 | 900 | 0.054 | 0.71 | 18.0 | 70 |

Production Example 4

<Production of Colorant Master Batch>

[Block Copolymer B1] (100 parts), a cyan pigment (C.I. Pigment blue 15:3) (100 parts), and ion-exchanged water (30 parts) were mixed well, and kneaded with an open roll kneader (KNEADEX manufactured by Nippon Coke & Engineering. Co., Ltd.). The kneading was started from the temperature of 90° C., and the temperature was gradually lowered to 50° C., to thereby produce [Colorant Master Batch P1] in which the ratio (mass ratio) between the resin and the pigment was 1:1.

Further, [Colorant Master Batch P2] to [Colorant Master Batch P12] were produced in the same manner, except that [Block Copolymer B1] was changed to [Block Copolymer B2] to [Block Copolymer B12].

Production Example 5

<Production of Wax Dispersion Liquid>

A reaction vessel equipped with a cooling pipe, a thermometer, and a stirrer was charged with paraffin wax (HNP-9 (melting point of 75° C.) manufactured by Nippon Seiro Co., Ltd.) (20 parts) and ethyl acetate (80 parts). The materials were heated to 78° C. to be dissolved well, stirred while being cooled to 30° C. in 1 hour, and subjected to wet pulverization with an ultra visco mill (manufactured by Aimex Corporation) at a liquid delivering rate of 1.0 kg/hour, at a disk peripheral velocity of 10 m/second, with zirconia beads having a diameter of 0.5 mm packed to 80% by volume, for 6 passes. Ethyl acetate was added to the resultant to adjust the solid content concentration thereof, to thereby produce [Wax Dispersion Liquid] having a solid content concentration of 20%.

Example 9

<Production of Toner 1>

A vessel equipped with a thermometer and a stirrer was charged with [Block Copolymer B1] (94 parts) and ethyl acetate (81 parts). The materials were heated to equal to or higher than the melting point of the resin to be dissolved well, to which [Wax Dispersion Liquid] (25 parts) and [Colorant Master Batch P1] (12 parts) were added. They were stirred at 50° C. with a TK homomixer (manufactured by Primix Corporation) at a rotation speed of 10,000 rpm to be dissolved and dissolved uniformly, to thereby obtain [Oil Phase 1]. The temperature of [Oil Phase 1] was retained at 50° C. in the vessel.

Next, another vessel equipped with a stirrer and a thermometer was charged with ion-exchanged water (75 parts), a 25% dispersion liquid of organic resin particles for dispersion stabilization (a copolymer of styrene/methacrylic acid/butyl acrylate/sodium salt of methacrylic acid-ethylene oxide adduct sulfuric acid ester) (manufactured by Sanyo Chemical Industries, Ltd.) (3 parts), carboxymethyl cellulose sodium (CELLOGEN BS-H-3 manufactured by Daiichi Kogyo Seiyaku Co. Ltd.) (1 part), a 48.5% aqueous solution of sodium dodecyldiphenylether disulfonate (ELEMINOL MON-7 manufactured by Sanyo Chemical Industries, Ltd.) (16 parts), and ethyl acetate (5 parts), and they were mixed and stirred at 40° C., to thereby produce a water phase solution ([Water Phase 1]). [Oil Phase 1] (50 parts) retained at 50° C. was added to the whole amount of the obtained [Water Phase 1], and they were mixed at from 45° C. to 48° C. with a TK homomixer (manufactured by Primix Corporation) at a rotation speed of 12,000 rpm for 1 minute, to thereby obtain [Emulsified Slurry 1].

A vessel equipped with a stirrer and a thermometer was charged with [Emulsified Slurry 1], and desolventized at 50° C. for 2 hours, to thereby obtain [Slurry 1].

The obtained [Slurry 1] (100 parts) of toner base particles was filtered at reduced pressure to thereby obtain a filtration cake. The filtration cake was subjected to the following washing process.

(1) Ion-exchanged water (100 parts) was added to the filtration cake, and they were mixed with a TK homomixer (at a rotation speed of 6,000 rpm for 5 minutes), and then filtered.

(2) A 10% sodium hydroxide aqueous solution (100 parts) was added to the filtration cake of (1), and they were mixed with a TK homomixer (at a rotation speed of 6,000 rpm for 10 minutes), and then filtered at reduced pressure.

(3) 10% hydrochloric acid (100 parts) was added to the filtration cake of (2), and they were mixed with a TK homomixer (at a rotation speed of 6,000 rpm for 5 minutes), and the filtered.

(4) An operation of adding ion-exchanged water (300 parts) to the filtration cake of (3), mixing them with a TK homomixer (at a rotation speed of 6,000 rpm for 5 minutes), and then filtering them was repeated twice, to thereby obtain [Filtration Cake 1].

The obtained [Filtration Cake 1] was dried with an air-circulating drier at 45° C. for 48 hours. After this, it was sieved through a 75 μm mesh, to thereby produce [Toner Base Particles 1].

Next, the obtained [Toner Base Particles 1] (100 parts) was mixed with hydrophobic silica (HDK-2000 manufactured by Wacker Chemie AG) (1.0 part) and titanium oxide (MT-150AI manufactured by Tayca Corporation) (0.3 parts) with a Henschel mixer, to thereby produce [Toner 1]. The particle size distribution, LAOS, pulse NMR relaxation times, and a phase image dispersion diameter of the obtained toner were measured. The results are shown in Table 4.

<Production of Carrier 1>

Mn ferrite particles (with a weight average diameter of 35 μm) (5,000 parts) were used as a core material.

A coating liquid prepared by dispersing toluene (300 parts), butyl cellosolve (300 parts), an acrylic resin solution (with a composition ratio (on a molar basis) of methacrylic acid:methyl methacrylate:2-hydroxyethyl acrylate of 5:9:3, a toluene solution with a solid content of 50% and a Tg of 38° C.) (60 parts), a N-tetramethoxymethyl benzoguanamine resin solution (with a degree of polymerization of 1.5, a toluene solution with a solid content of 7%) (15 parts), and alumina particles (with an average primary particle diameter of 0.30 μm) (15 parts) with a stirrer for 10 minutes was used as a coating material.

The core material and the coating liquid were subjected to a coater including a rotary bottom plate disk and a stirring blade in a fluid bed and configured to perform coating by forming a swirl flow, to thereby coat the core material with the coating liquid. The obtained coated product was burned in an electric furnace at 220° C. for 2 hours, to thereby obtain [Carrier 1].

<Production of Developer 1>

[Carrier 1] (100 parts) and [Toner 1] (7 parts) relative to the carrier were mixed uniformly with a Turbula mixer (manufactured by Willy A. Bachofen (WAB) AG) configured to stir materials with a rolling motion of a container at 48 rpm for 5 minutes, to thereby obtain [Developer 1], which was a two-component developer.

The produced two-component developer was filled in a developing unit of the direct-transfer type tandem image forming apparatus shown in FIG. 6 that employed a contact charging system, a two-component developing system, a second transfer system, a blade cleaning system, and a roller fixing system configured to perform heating from outside, to thereby perform image formation and performance evaluations described below. The results are shown in Table 5.

<Evaluations>

<<Fixability (Minimum Fixing Temperature)>>

With the image forming apparatus shown in FIG. 6, a full-surface solid image (with an image size of 3 cm×8 cm) was formed on transfer sheets (copy/print sheets <70> manufactured by Ricoh Business Expert Co., Ltd.) with an amount of transferred toner deposition of 0.85±0.10 mg/cm$^2$, and fixed thereon with the temperature of a fixing belt varied. With a drawing tester AD-401 (manufactured by Ueshima Seisakusho Co., Ltd.), drawing was applied to the surface of the obtained fixed images with a ruby needle (having a tip radium of from 260 μmR to 320 μmR, and a tip angle of 60°) under a load of 50 g. The drawing-applied surface was strongly scrubbed with fabric (HANIKOTTO #440 manufactured by Haneron Corporation Ltd.), and the temperature of the fixing belt at which almost no scraps of the images were produced was determined as a minimum fixing temperature. The solid image was formed on the transfer sheets at a position of 3.0 cm from the leading end thereof in the sheet passing direction. The speed at which the sheets were passed through the nip portion of the fixing device was 280 mm/second. The lower the minimum fixing temperature, the better the low temperature fixability. The evaluation was based on the following evaluation criteria.

[Evaluation Criteria]

A: 105° C. or lower

B: 115° C. or lower but higher than 105° C.

C: 130° C. or lower but higher than 115° C.

D: Higher than 130° C.

<<Heat Resistant Storage Stability (Penetration)>>

A 50 mL glass vessel was charged with each toner, and left in a thermostatic bath of 50° C. for 24 hours. This toner was cooled to 24° C., and the penetration (mm) thereof was measured according to a penetration test (JIS K2235-1991) and evaluated based on the criteria below. The greater the penetration, the better the heat resistant storage stability. When the penetration is less than 5 mm, the possibility that troubles will occur in use is high.

In the present invention, the penetration was expressed as a penetration depth (mm).

[Evaluation Criteria]

AA: The penetration was 25 mm or greater.

A: The penetration was 20 mm or greater but less than 25 mm.

B: The penetration was 10 mm or greater but less than 20 mm.

C: The penetration was 5 mm or greater but less than 10 mm.

D: The penetration was less than 5 mm.

<<Sheet Discharging Scratch Resistance Evaluation>>

The produced developer was set in IMAGIO C2802 (manufactured by Ricoh Company Limited), and a full-surface solid image (with an amount of toner deposition of 0.6 mg/cm$^2$) was printed on 10 A4-size sheets continuously. The printed images were observed visually, and evaluated based on the following evaluation criteria.

[Evaluation Criteria]

A: Scars and glossiness variation were not observed in all of the images.

B: Slight glossiness variation was observed visually in some of the images.

C: Glossiness variation was observed visually like a streak in some portions of some of the images.

D: The toner peeled from the image, and the sheet appeared.

<Pigment Dispersibility Evaluation>

The toner was buried in an epoxy resin, and solidified for one night. After this, a slice thereof having an average thickness of 80 nm was produced with an ultramicrotome (manufactured by Diatome Ltd.). Next, with a transmission electron microscope H7000 (manufactured by Hitachi Ltd.), the dispersed state of the pigment was observed, and evaluated based on the following evaluation criteria.

[Evaluation Criteria]

A: The pigment was dispersed in the toner (within the toner, not on the surface of the toner, regardless of whether uniformly or non-uniformly).

B: The pigment was slightly lopsidedly located on the surface of the toner, but dispersed also in the toner.

D: The whole of the pigment was located lopsidedly on the surface of the toner.

Examples 10 to 15 and 17 and Comparative Examples 5, 7, and 8

<Production of Toners 2 to 7, 9, 10, 12, and 13 and Developers 2 to 7, 9, 10, 12, and 13>

[Toner 2] to [Toner 7], [Toner 9], [Toner 10], [Toner 12], and [Toner 13], and [Developer 2] to [Developer 7], [Developer 9], [Developer 10], [Developer 12], and [Developer 13] were produced in the same manner as in Example 9, except that in the production of the toner of Example 9, [Block Copolymer B1] was changed to [Block Copolymer B2] to [Block Copolymer B12] as shown in Table 3 below respectively, and [Colorant Master Batch P1] was changed to [Colorant Master Batch P2] to [Colorant Master Batch P12] as shown in Table 3 below respectively, and quality evaluations of the toners and developers were performed. The results are shown in Table 4 and Table 5.

Example 16

<Production of Toner 8>

[Toner 8] and [Developer 8] were produced in the same manner as in Example 9, except that in the production of the toner of Example 9, [Block Copolymer B1] was changed to [Block Copolymer B4], [Block copolymer B4] (84 parts), [Crystalline Segment C1] (10 parts), and ethyl acetate (81 parts) were charged, and heated to equal to or higher than the melting point of the resin to be dissolved well to thereby produce an oil phase, and [Colorant Master Batch P1] was changed to [Colorant Master Batch P4], and quality evaluations of the toner and developer were performed. The results are shown in Table 4 and Table 5.

Comparative Example 6

<Production of Toner 11>

[Toner 11] and [Developer 11] were produced in the same manner as in Example 16, except that in the production of the toner of Example 16, [Block Copolymer B4] was changed to [Block Copolymer B7], and [Colorant Master Batch P4] was changed to [Colorant Master Batch P7], and quality evaluations of the toner and developer were performed. The results are shown in Table 4 and Table 5.

TABLE 3

| | Toner | Colorant master batch | Block copolymer |
|---|---|---|---|
| Ex. 9 | Toner 1 | P1 | B1 |
| Ex. 10 | Toner 2 | P2 | B2 |
| Ex. 11 | Toner 3 | P3 | B3 |
| Ex. 12 | Toner 4 | P4 | B4 |
| Ex. 13 | Toner 5 | P5 | B5 |
| Ex. 14 | Toner 6 | P6 | B6 |
| Ex. 15 | Toner 7 | P8 | B8 |
| Ex. 16 | Toner 8 | P4 | B4 |
| Ex. 17 | Toner 9 | P10 | B10 |
| Comp. Ex. 5 | Toner 10 | P9 | B9 |
| Comp. Ex. 6 | Toner 11 | P7 | B7 |
| Comp. Ex. 7 | Toner 12 | P11 | B11 |
| Comp. Ex. 8 | Toner 13 | P12 | B12 |

<1> A resin for a toner, wherein the resin for a toner is a copolymer including a crystalline segment, and wherein the resin for a toner has a maximum elastic stress value at 100° C. (ES100) of 1,000 Pa or less, and a maximum elastic stress value at 70° C. (ES70) of 1,000 Pa or greater when a temperature is lowered from 100° C. to 70° C., where the maximum elastic stress values are measured according to a large amplitude oscillatory shear procedure.

<2> The resin for a toner according to <1>, wherein the resin for a toner has a spin-spin relaxation time at 50° C. (t50) of 1.0 ms or shorter, a spin-spin relaxation time at 130° C. (t130) of 8.0 ms or longer when a temperature is raised from 50° C. to 130° C., and a spin-spin relaxation time at 70° C. (t'70) of 1.5 ms or shorter when the temperature is lowered from 130° C. to 70° C., where the spin-spin relaxation times are measured according to pulse NMR.

TABLE 4

| | | Resin in binder resin and use ratio | | | | | | | | | Phase image |
|---|---|---|---|---|---|---|---|---|---|---|---|
| | | | | Particle size distribution | | LAOS | | Pulse NMR relaxation time | | | dispersion diameter |
| | Toner | Block copolymer | Use ratio (% by mass) | Dv (μm) | Dv/Dn | ES100 (Pa) | ES70 (Pa) | t50 (ms) | t'70 (ms) | t130 (ms) | (nm) |
| Ex. 9 | Toner 1 | B1 | 100 | 5.3 | 1.15 | 2,600 | 50,000 | 0.058 | 0.43 | 9.45 | 60 |
| Ex. 10 | Toner 2 | B2 | 100 | 5.2 | 1.15 | 2,500 | 40,000 | 0.059 | 0.56 | 9.66 | 50 |
| Ex. 11 | Toner 3 | B3 | 100 | 5.3 | 1.14 | 2,500 | 35,000 | 0.058 | 0.68 | 9.56 | 50 |
| Ex. 12 | Toner 4 | B4 | 100 | 5.2 | 1.15 | 2,500 | 30,000 | 0.058 | 0.76 | 9.45 | 50 |
| Ex. 13 | Toner 5 | B5 | 100 | 5.3 | 1.14 | 2,000 | 20,000 | 0.058 | 0.82 | 9.77 | 50 |
| Ex. 14 | Toner 6 | B6 | 100 | 5.4 | 1.15 | 1,000 | 7,000 | 0.061 | 0.86 | 9.66 | 50 |
| Ex. 15 | Toner 7 | B8 | 100 | 5.2 | 1.14 | 2,000 | 28,000 | 0.056 | 0.78 | 9.80 | 50 |
| Ex. 16 | Toner 8 | B4 | 90 | 5.2 | 1.14 | 2,000 | 10,000 | 0.060 | 0.80 | 13.00 | 90 |
| Ex. 17 | Toner 9 | B10 | 100 | 5.3 | 1.17 | 2,950 | 43,000 | 0.054 | 0.05 | 10.00 | 60 |
| Comp. Ex. 5 | Toner 10 | B9 | 100 | 5.2 | 1.15 | 5,000 | 50,000 | 0.053 | 0.60 | 8.00 | 50 |
| Comp. Ex. 6 | Toner 11 | B7 | 90 | 5.3 | 1.13 | 1,000 | 3,000 | 0.060 | 0.90 | 20.00 | 90 |
| Comp. Ex. 7 | Toner 12 | B11 | 100 | 5.2 | 1.12 | 2,000 | 1,000 | 0.082 | 1.90 | 27.00 | 80 |
| Comp. Ex. 8 | Toner 13 | B12 | 100 | 5.3 | 1.16 | 3,500 | 100,000 | 0.052 | 0.50 | 8.90 | 50 |

TABLE 5

| | Toner/Developer evaluated | | Results of quality evaluations | | | |
|---|---|---|---|---|---|---|
| | | | Sheet discharging scratch resistance | Low temp. fixability | Heat resistant storage stability | Pigment dispersibility |
| Ex. 9 | Toner 1 | Developer 1 | A | B | AA | B |
| Ex. 10 | Toner 2 | Developer 2 | A | A | AA | B |
| Ex. 11 | Toner 3 | Developer 3 | A | A | AA | A |
| Ex. 12 | Toner 4 | Developer 4 | A | A | AA | A |
| Ex. 13 | Toner 5 | Developer 5 | B | A | A | A |
| Ex. 14 | Toner 6 | Developer 6 | B | A | B | A |
| Ex. 15 | Toner 7 | Developer 7 | A | A | AA | A |
| Ex. 16 | Toner 8 | Developer 8 | B | A | AA | B |
| Ex. 17 | Toner 9 | Developer 9 | A | B | AA | A |
| Comp. Ex. 5 | Toner 10 | Developer 10 | A | C | B | D |
| Comp. Ex. 6 | Toner 11 | Developer 11 | C | A | B | D |
| Comp. Ex. 7 | Toner 12 | Developer 12 | D | A | D | D |
| Comp. Ex. 8 | Toner 13 | Developer 13 | A | C | A | D |

Aspects of the present invention are as follows, for example.

<3> The resin for a toner according to <1> or <2>, wherein a binarized image obtained by binarizing a phase image of the resin for a toner observed with a tapping mode AFM with an intermediate value between a maximum phase difference and a minimum phase difference in the phase image includes first phase difference images formed by portions having a large phase difference and second phase difference images formed by portions having a small phase difference, the first phase difference images are dispersed in each of the second phase difference images, and the first phase difference images have a dispersion diameter of 100 nm or less.

<4> The resin for a toner according to any one of <1> to <3>, wherein constituent monomers of the copolymer includes a monomer containing an odd number of carbon atoms in a main chain thereof.

<5> The resin for a toner according to any one of <1> to <4>, wherein the copolymer further includes an amorphous segment.

<6> The resin for a toner according to <5>, wherein constituent monomers of the amorphous segment include a monomer containing an odd number of carbon atoms in a main chain thereof, and a monomer containing an even number of carbon atoms in a main chain thereof.

<7> The resin for a toner according to <6>, wherein the constituent monomers of the amorphous segment include the monomer containing an odd number of carbon atoms in the main chain thereof in an amount of from 1% by mass to 50% by mass relative to the amorphous segment.

<8> The resin for a toner according to any one of <1> to <7>, wherein constituent monomers of the crystalline segment include a monomer containing an even number of carbon atoms in a main chain thereof.

<9> The resin for a toner according to any one of <5> to <8>, wherein a mass ratio of the amorphous segment to the crystalline segment is from 1.5 to 4.0.

<10> The resin for a toner according to any one of <5> to <9>, wherein the crystalline segment and the amorphous segment are bonded via urethane linkage.

<11> The resin for a toner according to an one of <5> to <10>, wherein the amorphous segment has a glass transition temperature of from 50° C. to 70° C.

<12> The resin for a toner according to any one of <1> to <11>, wherein the crystalline segment has a melting point of from 50° C. to 75° C.

<13> A toner, including:

the resin for a toner according to any one of <1> to <12>.

<14> The toner according to <13>, wherein the toner has a maximum elastic stress value at 100° C. (ES100) of 3,000 Pa or less, and a maximum elastic stress value at 70° C. (ES70) of 5,000 Pa or greater when a temperature is lowered from 100° C. to 70° C., where the maximum elastic stress values are measured according to a large amplitude oscillatory shear procedure.

<15> The toner according to <13> or <14>, wherein the toner has a spin-spin relaxation time at 50° C. (t50) of 1.0 ms or shorter, a spin-spin relaxation time at 130° C. (t130) of 8.0 ms or longer when a temperature is raised from 50° C. to 130° C., and a spin-spin relaxation time at 70° C. (t'70) of 2.0 ms or shorter when the temperature is lowered from 130° C. to 70° C., where the spin-spin relaxation times are measured according to pulse NMR.

<16> The toner according to any one of <13> to <15>, wherein a binarized image obtained by binarizing a phase image of the toner observed with a tapping mode AFM with an intermediate value between a maximum phase difference and a minimum phase difference in the phase image includes first phase difference images formed by portions having a large phase difference and second phase difference images formed by portions having a small phase difference, the first phase difference images are dispersed in each of the second phase difference images, and the first phase difference images have a dispersion diameter of 200 nm or less.

<17> A developer, including the toner according to any one of <13> to <16>.

<18> An image forming apparatus, including:

an electrostatic latent image bearing member;

an electrostatic latent image forming unit configured to form an electrostatic latent image on the electrostatic latent image bearing member; and a developing unit including a toner and configured to develop the electrostatic latent image formed on the electrostatic latent image bearing member to form a visible image, wherein the toner is the toner according to any one of <13> to <16>.

<19> A process cartridge, including:

an electrostatic latent image bearing member, and a developing unit including a toner and configured to develop an electrostatic latent image formed on the electrostatic latent image bearing member to form a visible image, wherein the process cartridge is attachable to and detachable from a body of an image forming apparatus, and wherein the toner is the toner according to any one of <13> to <16>.

REFERENCE SIGNS LIST

10 electrostatic latent image bearing member
61 developing device
100 image forming apparatus

The invention claimed is:

1. A resin for a toner, wherein:

the resin for a toner is a copolymer that comprises a crystalline segment and an amorphous segment;

the resin for a toner has a maximum elastic stress value at 100° C. (ES100) of 1,000 Pa or less, and a maximum elastic stress value at 70° C. (ES70) of 1,000 Pa or greater when a temperature is lowered from 100° C. to 70° C., where the maximum elastic stress values are measured according to a large amplitude oscillatory shear procedure;

constituent monomers of the amorphous segment comprise a monomer of a diol component; and the monomer of the diol component comprises a monomer of a diol component having three carbon atoms in a main chain thereof.

2. The resin for a toner according to claim 1, wherein the resin for a toner has a spin-spin relaxation time at 50° C. (t50) of 1.0 ms or shorter, a spin-spin relaxation time at 130° C. (t130) of 8.0 ms or longer when a temperature is raised from 50° C. to 130° C., and a spin-spin relaxation time at 70° C. (t'70) of 1.5 ins or shorter when the temperature is lowered from 130° C. to 70° C., where the spin-spin relaxation times are measured according to pulse NMR.

3. The resin for a toner according to claim 1, wherein a binarized image obtained by binarizing a phase image of the resin observed with a tapping mode AFM with an intermediate value between a maximum phase difference and a minimum phase difference in the phase image includes first phase difference images formed by portions having a large phase difference and second phase difference images formed by portions having a small phase difference, the first phase difference images are dispersed in each of the second phase difference images, and the first phase difference images have a dispersion diameter of 100 nm or less.

4. The resin for a toner according to claim 1, wherein constituent monomers of the amorphous segment further comprise a monomer of a diol component having an even number of carbon atoms in a main chain thereof.

5. The resin for a toner according to claim 4, wherein the constituent monomers of the amorphous segment comprise the monomer of the diol component having three carbon atoms in a main chain thereof in an amount of from 1% by mass to 50% by mass relative to the amorphous segment.

6. The resin for a toner according to claim 1, wherein:

constituent monomers of the crystalline segment comprise a monomer of a diol component; and the monomer of the diol component comprises a monomer of a diol component having an even number of carbon atoms in a main chain thereof.

7. The resin for a toner according to claim 1, wherein a mass ratio of the amorphous segment to the crystalline segment is from 1.5 to 4.0.

8. The resin for a toner according to claim 1, wherein the crystalline segment and the amorphous segment are bonded via urethane linkage.

9. The resin for a toner according to claim 1, wherein the amorphous segment has a glass transition temperature of from 50° C. to 70° C.

10. The resin for a toner according to claim 1, wherein the crystalline segment has a melting point of from 50° C. to 75° C.

11. A toner, comprising:

the resin for a toner according to claim 1.

12. The toner according to claim 11, wherein the toner has a maximum elastic stress value at 100° C. (ES100) of 3,000 Pa or less, and a maximum elastic stress value at 70° C. (ES70) of 5,000 Pa or greater when a temperature is lowered from 100° C. to 70° C., where the maximum elastic stress values are measured according to a large amplitude oscillatory shear procedure.

13. The toner according to claim 11, wherein the toner has a spin-spin relaxation time at 50° C. (t50) of 1.0 ms or shorter, a spin-spin relaxation time at 130° C. (t130) of 8.0 ms or longer when a temperature is raised from 50° C. to 130° C., and a spin-spin relaxation time at 70° C. (t'70) of 2.0 ms or shorter when the temperature is lowered from 130° C. to 70° C. where the spin-spin relaxation times are measured according to pulse NMR.

14. The toner according to claim 11, wherein a binarized image obtained by binarizing a phase image of the toner observed with a tapping mode AFM with an intermediate value between a maximum phase difference and a minimum phase difference in the phase image includes first phase difference images formed by portions having a large phase difference and second phase difference images formed by portions having a small phase difference, the first phase difference images are dispersed in each of the second phase difference images, and the first phase difference images have a dispersion diameter of 200 nm or less.

15. A developer, comprising:

the toner according to claim 11.

16. An image forming apparatus, comprising:

an electrostatic latent image bearing member;

an electrostatic latent image forming unit configured to form an electrostatic latent image on the electrostatic latent image bearing member; and a developing unit that comprises a toner and is configured to develop the electrostatic latent image formed on the electrostatic latent image bearing member to form a visible image, wherein the toner is the toner according to claim 11.

17. A process cartridge, comprising:

an electrostatic latent image bearing member; and a developing unit that comprises a toner and is configured to develop an electrostatic latent image formed on the electrostatic latent image bearing member to form a visible image, wherein the process cartridge is attachable to and detachable from a body of an image forming apparatus, and wherein the toner is the toner according to claim 11.

* * * * *